US005689242A

United States Patent [19]

Sims et al.

[11] Patent Number: 5,689,242

[45] Date of Patent: Nov. 18, 1997

[54] CONNECTING A PORTABLE DEVICE TO A NETWORK

[75] Inventors: Nathaniel M. Sims, Wellesley Hills, Mass.; Steven P. Kadner, Albuquerque, N. Mex.; Kevin Ferguson, Albuquerque, N. Mex.; Chris Martinez, Albuquerque, N. Mex.; Robert Rajala, Albuquerque, N. Mex.

[73] Assignees: The General Hospital Corporation, Boston, Mass.; Aquila Technologies Group, Inc., Albuquerque, N. Mex.

[21] Appl. No.: 282,051

[22] Filed: Jul. 28, 1994

[51] Int. Cl.[6] ..... G08B 21/00

[52] U.S. Cl. ..... 340/652; 340/572; 340/568

[58] Field of Search ..... 364/403; 340/652, 340/572, 568, 571, 693, 533, 538, 825.54

[56] References Cited

U.S. PATENT DOCUMENTS

| | | | |
|---|---|---|---|
| 2,686,297 | 8/1954 | Hutt | 339/14 |
| 3,942,859 | 3/1976 | Korodi | 339/113 |
| 4,081,208 | 3/1978 | Meade | 350/96.2 |
| 4,111,509 | 9/1978 | Novak | 339/14 |
| 4,320,938 | 3/1982 | Gunnersen et al. | 350/96.21 |
| 4,333,072 | 6/1982 | Beigel | 340/572 |
| 4,390,237 | 6/1983 | Marazzi | 350/96.2 |
| 4,390,868 | 6/1983 | Garwin | 340/652 |
| 4,432,604 | 2/1984 | Schwab | 350/96.21 |
| 4,465,333 | 8/1984 | Caserta et al. | 350/96.2 |
| 4,545,077 | 10/1985 | Drapala et al. | 455/612 |
| 4,578,573 | 3/1986 | Flies et al. | 235/492 |
| 4,654,658 | 3/1987 | Walton | 340/825.54 |
| 4,678,264 | 7/1987 | Bowen et al. | 350/96.2 |
| 4,721,358 | 1/1988 | Faber et al. | 350/96.21 |
| 4,767,181 | 8/1988 | McEowen | 350/96.21 |
| 4,812,823 | 3/1989 | Dickerson | 340/572 |
| 4,915,639 | 4/1990 | Cohn et al. | 439/188 |
| 4,918,432 | 4/1990 | Pauley et al. | 340/573 |
| 5,205,749 | 4/1993 | Weingartner | 439/335 |
| 5,225,653 | 7/1993 | Martin et al. | 235/441 |
| 5,235,326 | 8/1993 | Beigel et al. | 340/825.54 |
| 5,319,363 | 6/1994 | Welch et al. | 340/825.36 |
| 5,396,227 | 3/1995 | Caroll et al. | 340/573 |
| 5,434,775 | 7/1995 | Sims et al. | 364/403 |
| 5,491,468 | 2/1996 | Everett et al. | 340/572 |

FOREIGN PATENT DOCUMENTS

| | | | |
|---|---|---|---|
| 4-112468 | 4/1992 | Japan . | |
| 2106662 | 4/1983 | United Kingdom | G02B 7/26 |
| 2110409 | 6/1983 | United Kingdom | G02B 7/26 |

OTHER PUBLICATIONS

Datakey, Data Sheet "Serial Memory Keys DK1000, DK2000 & DK4000", 1990.

Dallas Semiconductor, "DS9092K Touch Memory Starter Kit" User's Manual, Aug. 1991.

Dallas Semiconductor, 1991 Automatic Identification Data Book, "Automatic I.D.", pp. iii–xvi, 1991.

Dallas Semiconductor, 1991 Automatic Identification Data Book, "Communicating With Touch Memories", pp. 63–65, Apr. 1991.

(List continued on next page.)

*Primary Examiner*—Jeffery Hofsass
*Assistant Examiner*—Ashok Mannava
*Attorney, Agent, or Firm*—Fish & Richardson P.C.

[57] ABSTRACT

A tag associated with a device and that identifies the device with respect to other devices is connected to a communication link with the same connector used to connect the device to a source of power. The device connector includes an element for receiving electrical power and a data contact connected to the tag. An electrical power connector (which serves as the power source) has an element for engaging the element of the device connector and applying electrical power thereto, and another data contact connected to the communication link. When the device connector is engaged with the electrical power source connector, the data contacts engage one another and establish a data path between the communication link and the tag. The connection to the communication link allows information to be exchanged between the communication link and the tag.

69 Claims, 24 Drawing Sheets

OTHER PUBLICATIONS

Dallas Semiconductor, 1991 Automatic Identification Data Book, "DS1990 Touch Serial Number", pp. 66–74, Apr. 1991.

Dallas Semiconductor, 1991 Automatic Identification Data Book, "DS1992 Touch Memory", pp. 104–105, Apr. 1991.

Dallas Semiconductor, 1991 Automatic Identification Data Book, "DS9092 Touch Memory Probe", pp. 110–112, Apr. 1991.

Dallas Semiconductor, 1991 Automatic Identification Data Book, "DS9093 Touch Memory KeyRing Mount", p. 114, Apr. 1991.

Dallas Semiconductor, 1991 Automatic Identification Data Book, "DS9094 Touch Memory Clip", p. 115, Apr. 1991.

Stephen L. Serber, Datakey, Inc., "Selecting a Data Carrier", reprinted from Memory Card & Systems Design, Nov.–Dec. 1991.

Dallas Semiconductor, "DS2251(T) 128K Micro Stik", Jan. 23, 1992, pp. 45–64.

Dallas Semiconductor, Touch Memory Products Technical Bulletin #1, "Communicating With Touch Memories Over Long Cable Lengths", May 14, 1992.

Dallas Semiconductor, "Touch Memory at the Bedside", 1992.

Dallas Semiconductor, "50 Ways to Touch Memory", second edition, Oct. 1992, pp. 1–92.

Dallas Semiconductor, Book of DS199x Touch Memory Standards, "Touch Memory Overview", Oct. 1992, pp. 1–9.

Dallas Semiconductor, Book of DS199x Touch Memory Standards, "Product Overview", Oct. 1992, pp. 11–17.

Dallas Semiconductor, Book of DS199x Touch Memory Standards, "Logical Standards and Characteristics", Oct. 1992, pp. 39–51.

Automatic I.D. News for Automated Data Capture Systems Management, "New Products", vol. 8, No. 10, Oct. 1992, p. 90.

Dallas Semiconductor, 1992–1993 Product Data Book, "DS1992/DS1993/DS1994", pp. 12–35–12–57.

Motorola, "Neuron Chips LonWorks Technology", Apr. 1993, pp. 1–8.

Echelon Corporation, "LonWorks Products 1994", 1993, pp. 15–22.

Dallas Semiconductor, "Touch the Future Automatic Identification by Dallas Semiconductor", pp. 1–8.

Product Sheet "Colorizing your Touch Memories keeps you in touch with the future".

CONNECTING A PORTABLE DEVICE TO A NETWORK

CROSS REFERENCE TO RELATED APPLICATIONS

This application is related to copending U.S. application Ser. No. 08/146,929, which is incorporated herein by reference.

BACKGROUND OF THE INVENTION

This invention relates to managing an inventory of portable devices.

Portable devices are used by many different types of facilities. Hospitals, for example, use large numbers of portable patient care devices (such as pacemakers, vital signs monitors, and fluid infusion pumps). When the devices are not in use, they are typically placed in one of numerous local storage areas (e.g., storerooms) distributed throughout the hospital, where the devices can be accessed immediately by hospital workers for patient care and returned to storage rapidly after use.

Hospital personnel should be able to quickly determine the locations of devices that are not in use, the quantity and location of devices needing between-use processing and repair, as well as the number of devices that are available for use with respect to parlevels (i.e., ranges indicating the number of devices to be maintained in a location to prevent an action from being taken, e.g., restocking a storeroom). This is necessary for hospital personnel to provide adequate patient care, to efficiently manage the inventory of devices, and to direct the activities of equipment service technicians responsible for stocking, between-use processing, periodic maintenance, repair and inventory.

One way of monitoring devices is by tracking the devices manually as they are placed in, and later removed from, the storage areas. The conditions of the devices (e.g., ready for use, repair needed, cleaning required, etc.) are indicated by affixing tags to them that have a characteristic (such as color) indicative of the condition, and making a like entry in the manual tracking system.

Some manufacturing facilities communicate with and track locations of portable equipment on a factory floor by placing transmitters (e.g., infrared emitters or radio frequency RF tags) on the devices, and positioning receivers at several locations around the floor. The signal sent by each transmitter includes a unique code that identifies the device, and the position of the device is determined based on characteristics (e.g., strength or phase) of that signal as received by one or more receivers.

Other schemes equip each device in an inventory with a bar code. The devices are tracked by running the bar code on each device through a bar code reader when the device is moved from one location to another.

SUMMARY OF THE INVENTION

This invention combines the simple, routine act of connecting a device to a source of power with connecting a tag that identifies the device to a communication link. As a result, connection to a network is made transparently to the user, without any steps on his or her part other than simply "plugging-in" the device. Because users are highly likely to follow such a simple regime for connecting devices to the network (in appropriate areas, such as storerooms), the efficiency of a monitoring system (such as that described in co-pending U.S. patent application Ser. No. 08/146,929, entitled "Managing an Inventory of Devices") is dramatically enhanced.

In one aspect of the invention, the device is equipped with a connector that includes an element for engaging a corresponding element of an electrical power connector, and another element for establishing a data path between the tag and the electrical power connector when the elements are engaged.

Preferred embodiments include the following features.

The element of the connector includes a data contact connected to the tag and positioned on the connector to engage a corresponding data contact of the electrical power connector. In a particularly useful embodiment, the connector is an AC power plug, and the electrical power connector is an AC outlet.

Several alternative constructions for the connector are possible.

For example, in one embodiment, the data contact is mounted to the connector through a spring for resiliently urging the data contact against the corresponding data contact of the electrical power connector. The data contact and the element of the connector are spaced from each other on a surface of the connector that abuts the electrical power connector. In a particularly useful design, the data contact is disposed in a selected orientation with respect to the ground pin of the AC plug. The ground pin is electrically connected to a ground contact of the tag.

In another approach, the element includes the ground pin of the connector, and the data contact is supported by and electrically insulated from the ground pin. For example, the data contact includes an electrically conductive member mounted by an insulator to the ground pin. The ground contact of the tag is electrically connected to the ground pin.

Preferably, the ground pin includes an opening (e.g., the pin is U-shaped or hollow). The data contact is disposed in the opening. The electrical connections between the tag and the data and ground contacts can be disposed in an insulating sheath disposed in the opening, but this is not required; the data contact need only be insulated from the ground contact and the ground pin.

The tag may be disposed in numerous locations. For example, in one embodiment, the tag is mounted within the opening of the ground pin. In another configuration, the tag is mounted within a housing of the connector. A second connector that is, e.g., mounted on the housing, is electrically connected to the tag for parallel access. The tag can be removed from the housing and replaced (such as with another tag, or with a repaired tag). The tag may also include an illumination device energizable by circuitry in the tag in response to a command received via the data path.

The connector preferably is coupled to the device via a cord that includes wiring for applying electrical power to the device when the connector is engaged with the electrical power connector. Alternatively, the power connection terminates at the connector; that is, the connector is a "dummy" connector used with, e.g., a non-powered device.

In another embodiment, the connector comprises an adapter that receives a plug electrically connected to the device by a cord and electrically connects the plug to the electrical power connector to apply electrical power to the device. This allows a device to be retrofitted with a tag without replacing the plug.

The tag can be disposed externally to the connector. For example, the tag may be mounted at the device itself. In this case, the cord provides at least one electrical connection between the tag and the data contact (such as with an extra connector that releasably contacts the tag). A second, parallel access connector may also be provided.

Preferably, the tag comprises an electronic memory including unique information identifying the device with respect to the other devices. The information is accessible for reading from the electrical power connector via the data path when the element is engaged with the corresponding element. In some embodiments, the electronic memory also includes storage for other information about the device, and the storage is accessible from the electrical power connector via the data path. The tag storage is optionally electrically interfaced with a processor of the device.

Another aspect of the invention concerns the electrical power connector. In addition to the power connection element, the electrical power connector includes an element for establishing a data path between a communication link associated with the electrical power connector and a tag linked to a device connector when power connection elements of the electrical power connector and the device connector are engaged, thereby to provide access to the tag from the communication link.

Preferred embodiments include the following features.

The device connector is a plug, and the electrical power connector is a power outlet. The element that establishes the data path includes a data contact connected to the communication link and positioned on the outlet to engage the data contact of the plug.

In one embodiment, the data contact of the outlet is disposed on a substrate mounted to an exterior surface thereof. Alternatively, the data contact is disposed on the connector adjacent to the power connection element.

In yet another embodiment, the power connection element includes a ground terminal for receiving a ground pin of the plug. The data contact of the outlet is mounted to and electrically insulated from the ground terminal. The data contact is disposed in the ground terminal to slidingly contact the data contact of the plug when the ground pin is inserted in the ground terminal. The data contacts of the plug and the outlet are arranged to avoid short circuiting of the outlet's data contact to the ground terminal.

The power connection element includes one or more receptacles, each of which can receive the plug, and each having its own data contact. The data contacts are connected to the same or different communication links.

The electrical power connector also includes a terminal connected to the communication link to provide an external electrical connection to the link. Among other advantages, this allows multiple connectors to be "daisy-chained" together on the same communication link.

In some embodiments, an auxiliary connector associated with the electrical power connector is provided. The auxiliary connector receives one or more other tags associated with other devices, and connects these other tags to either the same communication link that serves the power connector, or to another communication link.

The data contact of the electrical power connector may be linked to a second connector—for example, a connector configured to engage an input port of a computer. This approach allows a computer to exchange information with the tag linked to the power connector.

In still another aspect, the invention provides an assembly including the tag and its data and ground contacts, and an insulator for insulating the data contact from the ground contact; at least the data and ground contacts and the insulator are sized to fit within a cavity in a ground element of a connector with the ground contact in electrical contact with the ground element and the data contact insulated from the ground element. The data contact is positioned to establish, when the connector is engaged with mating connector, a data path over which the information is accessible from the mating connector.

In preferred embodiments, the insulator insulates a pair of wires connected between the tag and the data contact and the ground contact from the ground element (which is, e.g., the ground pin of a plug). The insulator may be a sheath disposed within the cavity within which at least the wires are disposed. Alternatively, the insulator is an adhesive for securing the data contact to the ground pin. The tag is disposed in the cavity of the ground pin.

In any of the aspects of this invention, the communication link may be part of a network a branch of which includes an AC power line that carries electrical power. If so, a transceiver is provided for exchanging tag information between the communication link and the AC power line. Moreover, the network may also implement a security system, including a camera for producing an image of a location in which the electrical power connector is disposed. The camera transmits the image of the location over the network in response to a selected event. A monitor identifies a user who disconnects a device connector from the electrical connector, and generates an alarm if the user is unauthorized to do so. The alarm serves as the selected event that triggers the camera. The monitor includes a reader for reading a tag that is associated with the user and that identifies the user with respect to other users.

The security system helps ensure that only authorized individuals remove devices from a room. For example, a user is required to present his ID card (which includes the user's tag) to the reader before removing a device connected to the electrical connector. The alarm is coordinated with the power connector so that if a user disconnects a device before touching his ID card to the reader, the alarm will sound and/or the camera will take a picture of the individual. An integrated alarm and inventory system of this sort allows inventory items to be securely kept in otherwise unlocked storage rooms.

This type of security system is particularly useful in a home health-care support environment. For example, the monitoring system can be used to record which employees have checked out certain devices for use in a patient's home.

The connection scheme provided by this invention is highly user-friendly, and requires almost no training. Also, because many devices are normally "plugged in" during storage (i.e., connected to electrical power connectors located throughout the facility and equipped with network communication links), the majority of stored AC-powered devices in inventory will be connected to the monitoring system at any one time. Users are not likely to forget to connect the devices to the communication links, because they have no special steps to perform. By not relying on the users' skill or memory to accurately connect the devices to the communications links, the risk of user error is minimal, particularly compared to schemes that use bar code readers and the like, which require that the user carefully pass the reader over the code for accurate reading. This allows the monitoring system to maintain up to date, highly accurate information on device locations.

The connectors are simple to construct, and are fully compatible with standard plugs and outlets. For example, the tag-equipped plug retains the form and size of an ordinary AC plug, and can be used with any ordinary wall outlet. Any device can thus be equipped with the modified AC plug described above without losing any of its portability or versatility.

The invention allows the device monitoring system to be implemented in an incremental fashion, by equipping devices and locations with the connectors described herein only as they are needed. This approach is much more flexible than schemes requiring an entire communication network to be installed at one time, i.e., an all-or-none scheme. The system can also be easily modified as inventory management needs change.

Moreover, only a small amount of data is transferred over the network, compared to the large data flow (and data analysis) requirements of an all-facility RF or infrared (IR) device locating and management system. As a result, the monitoring system is able to maintain a high level of data integrity and communicate valuable information over the network while keeping the data burden relatively small.

Other features and advantages of the invention will become apparent from the following detailed description, and from the claims.

DESCRIPTION OF PREFERRED EMBODIMENTS

Introduction

At the outset, we note that this invention is related to that described and claimed in copending U.S. patent application Ser. No. 08/146,929, entitled "Managing an Inventory of Devices" (hereinafter, the "'929 application"), which is incorporated herein by reference. To provide context for the description of embodiments of the present invention, the subject matter of the '929 application is briefly discussed in the following paragraphs. For a full description of that invention, the reader is referred to the '929 application.

Figure 1:
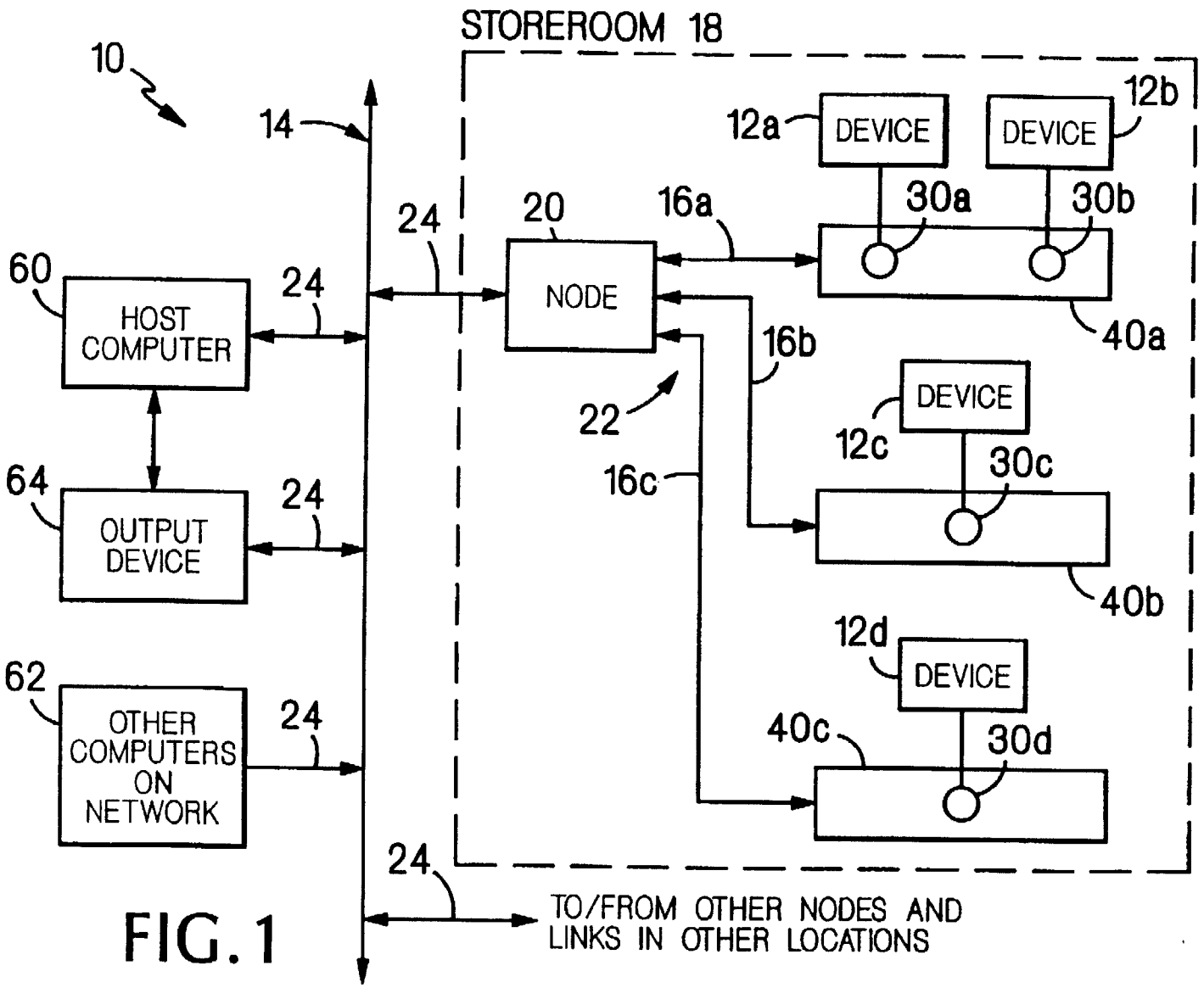
FIG. 1 is a block diagram of a system for monitoring an inventory of devices through the use of a network.

FIG. 1 is a simplified block diagram of a system 10 for managing an inventory of multiple portable devices **12*a*–12*d* (designated generally as 12) in a facility, such as a hospital, by determining the locations and conditions of devices 12 on a network 14 of communication links, designated generally as 16. Each communication link 16 is uniquely addressable and corresponds to a location in the hospital. For example, communication links 16*a*, 16*b*, 16*c* are assigned uniquely addressable areas of a storeroom 18, while other communication links 16 (not separately shown) correspond to other uniquely addressable locations (such as additional storerooms or patient rooms). A node 20 associated with storeroom 18 receives communication links 16*a*, 16*b*, 16*c* at a corresponding set of ports 22, and provides an interface to network 14 via a network branch 24**.

Figure 3:
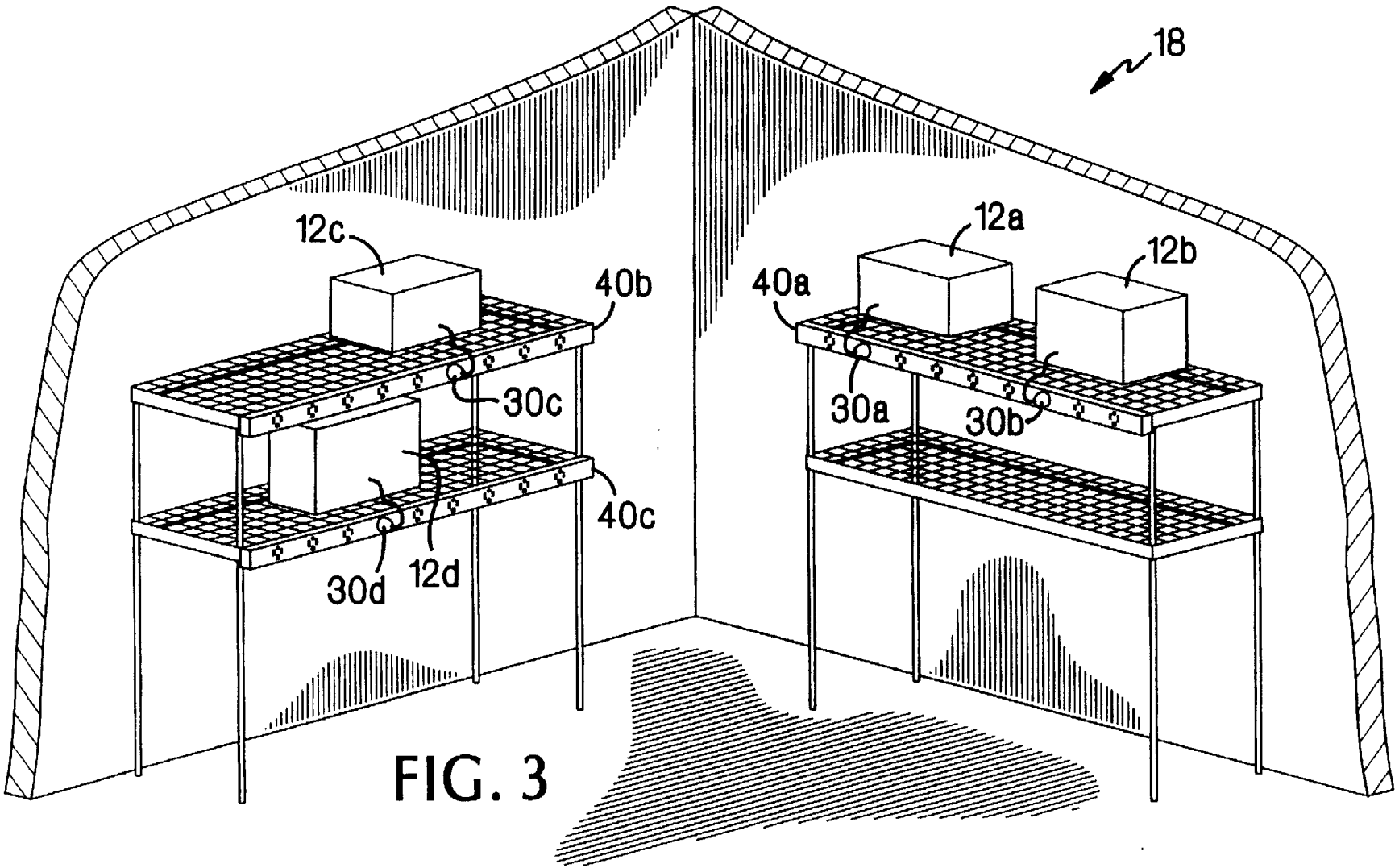
FIG. 3 shows a storeroom in which devices are located for monitoring by the system of FIG. 1.

Communication links **16*a*, 16*b*, and 16*c* correspond to various conditions of devices 12 stored in room 18. For example, communication link 16*a* is associated with a storeroom area in which devices 12*a*, 12*b* that are ready for use are placed. Devices to be cleaned (such as device 12*c*) or repaired (e.g., device 12*d*) are disposed in other storeroom areas, each of which is assigned a communication link 16*b*, 16*c*. These areas are, for example, different shelves or sets of shelves in storeroom 18 (FIG. 3**).

Only three communication links 16, one storeroom 18, one node 20, and four devices **12*a*–12*d* are shown for ease of illustration. As discussed in the '929 application, network 14 typically includes many more communication links 16 and nodes 20 for serving several additional, uniquely addressable locations in the hospital. Simply put, one or more communication links 16 are assigned to a sufficient number of rooms or other areas in the hospital at which devices 12 are likely to be stored or used to allow system 10 to track the locations and/or the conditions of the hospital's entire inventory of portable devices 12 to whatever level of detail is desired. Examples of such devices 12** in a hospital setting include patient care devices such as infusion pumps, vital signs monitors, sequential compression devices, pacemakers, and EKG machines, as well as other types of devices (e.g., electric blankets, wheelchairs, and carts for carrying bulky patient care devices).

Figure 2:
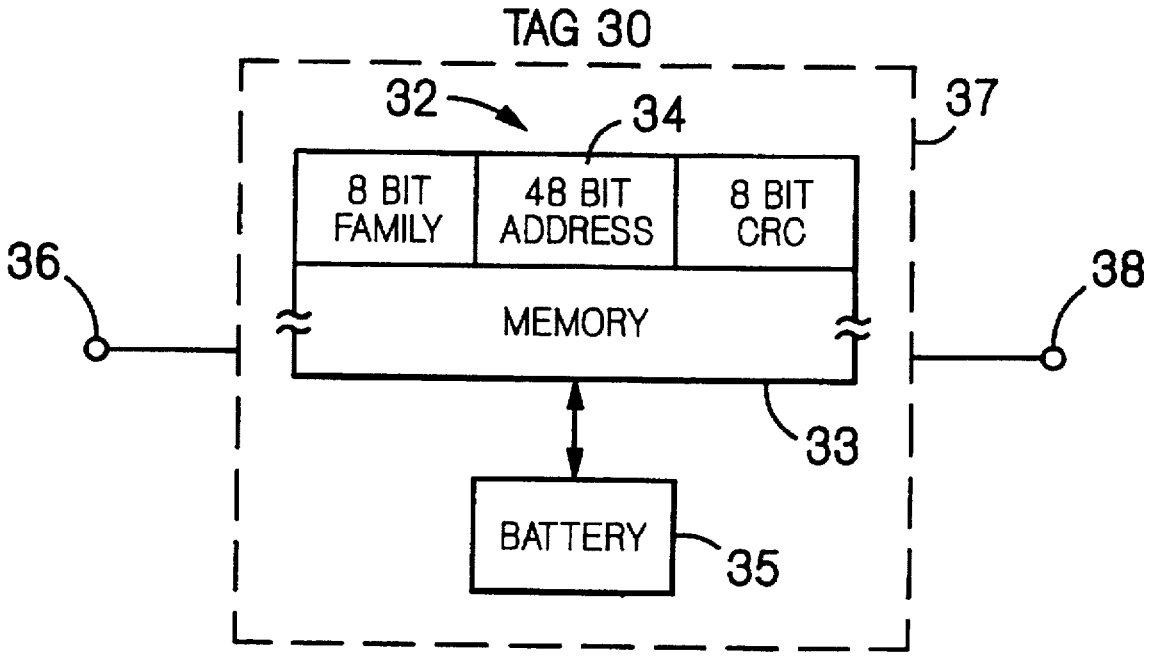
FIG. 2 shows the data structure and other aspects of an electronic tag.

Referring also to FIG. 2, every device 12 that is to be tracked (e.g., devices **12*a*–12*d*) is equipped with a corresponding electronic tag 30*a*–30*d* (designated generally as 30) that uniquely identifies device 12. Tag 30** is any electronic data label or carrier having the appropriate electrical characteristics for the functionality described below. One such electronic data label is the "touch memory" or "silicon serial number" manufactured by Dallas Semiconductor Corporation of Dallas, Tex. under numerous part numbers (e.g., DS1990–DS1994 and DS2401); these devices are typically packaged in a stainless steel can (described below), but of course other parts having similar functionality but different form factors (i.e., packaging), such as that of a TO-92 transistor or a diode package, may be used instead. Properties of the "touch memory" (TM) which are advantageous for use with the invention include:

- the TMs are low cost, small in size, and have low power requirements;
- each TM has a unique identification number (discussed below);
- the TMs can be used as stand-alone information carriers or connected to a network for information transfer;
- multiple TMs can be read simultaneously over a communication link, and their presence on the communication link can be detected continuously;
- the TMs support chip-to-chip communication (i.e., there is no requirement for proprietary readers);
- at least some of the TMs include a memory in addition to the unique identification;
- the TMs are available in a stainless steel can or housing and can tolerate extreme physical, chemical, and thermal conditions; and
- the TMs support a so-called "one-wire" communication protocol (discussed below) which requires only a single wire in addition to a ground reference to allow data to be transferred to and from the TMs (a typical implementation of the protocol may include half-duplex, serial communication at data rates such as 16.3 Kbits/sec. or 115.2 Kbits/sec.);
- a family of low-cost tag reading devices (e.g., TouchWands™ and the like), available from Dallas Semiconductor and other sources, provide easily-implemented interoperability between TMs and existing data collection and management infrastructures.

As shown in FIG. 2, tag 30 includes a unique identification in the form of a data structure 32 comprising a forty-eight bit tag address 34, an eight bit CRC code, and an eight bit family code, all of which are laser etched in memory of tag 30 during manufacturing. Tag 30 also may include additional memory 33 (discussed below) for storing data (such as maintenance and ownership information) about device 12 and a battery 35 for powering memory 35. The components of tag 30 are packaged 37 in any suitable way (e.g., in the aforementioned stainless steel can, a TO-92 transistor package, or an integrated circuit) and equipped with a pair of data ports 36, 38 for accessing data structure 32 (and memory 33, if provided).

Each communication link 16 includes a pair of wires—a data wire and a ground wire—(not separately shown), and is provided with a connector 40*a*, 40*b*, 40*c* (designated generally as 40) for connecting data ports 36, 38 of tags 30 across the wires of link 16. Thus, communication links 16 and connectors 40 provide electrical connections between node ports 22 and tags 30 of devices 12 disposed in the location to which communication links 16 are assigned.

Referring also to FIG. 3 and as noted above, storeroom 18 is subdivided into areas that correspond to the different device conditions and which include one or more shelves for devices 12. Communication links 16*a*–16*c* are physically wired to the shelves that they serve, and connectors 40*a*–40*c* are located on or near the shelves for receiving tags 30. For example, connectors 40*a*–40*c* are mounted on the fronts of the shelves, as shown; alternative placements include the bottoms of the shelves, above the shelves, or on the wall behind the shelves.

During operation, tag-reading circuitry associated with each node 20 communicates over the data wires of communication links 16 using a so-called "one wire protocol," and employs a "divide and conquer" procedure to read data structures 32 of all tags 30 connected to each link 16. In this way, the tag-reading circuitry detects all devices 12 that are connected to its ports 22. This operation and the tag-reading circuitry are fully discussed in the '929 application and will not be repeated here.

Thus, referring again to FIG. 1, a user who places a device 12 in any location (such as storeroom 18) need do no more than place device 12 in the appropriate area (such as on one of the shelves shown in FIG. 3) and connect tag 30 of that device to a connector 40. Transparently to the user, the tag-reading circuitry associated with node 20 reads data structure 32 and correlates it with the identity of the port 22 on which data structure 32 is read. The tag-reading circuitry associated with all nodes 20 report this information to one or more host computers 60 (only one of which is shown) on network 14. Host computer 60 maintains databases on all locations (and, where applicable, the conditions) of devices 12. The databases are accessible by users (e.g., hospital personnel) at host computer 60, or at other computers 62 on network 14, and thus serve as highly valuable tools for assisting hospital personnel in locating stored devices 12 and managing the inventory of devices 12. The databases are implemented using any suitable database management system, such as Microsoft "Foxpro™ 2.5 Database Management System for DOS" or "Microsoft Access™ 2.1 for Windows."

Reports of the locations and conditions of selected devices 12 are generated by computers 60, 62 using the database information, and are transmitted over network branches 24 for use by output devices 64. Examples of output devices 64 include computers for displaying the reports, printers for printing the reports, and facsimile equipment for faxing reports to selected destinations. Network computers 60, 62 can also send messages that contain at least some of the information in the reports to a user. This may be done by telephone or by pager (not shown). All of these operations are described in detail in the '929 application and will not be repeated here.

The '929 application describes several ways of connecting tag 30 (which is secured to a card and tethered to its associated device 12) across the wires of a communication link 16 via a connector 40. In one embodiment, each connector 40 includes an elongated, plastic housing equipped with a slot for receiving multiple tags 30 side-by-side. When the user slides a tag 30 into the slot, contact is made between tag data ports 36, 38 and the two wires of communication link 16. In another embodiment, the elongated connector includes a set of resilient metal fingers that serve as the ground wire of communication link 16 and hold tags 30 in the slot. Another example of a connector for receiving multiple tags 30 is a magnetic strip which holds tags 30 in place by magnetic attraction. In still another approach described in the '929 application, each communication link 16 is equipped with a number of parallel connectors, each for receiving and connecting one tag 30 across the wires of communication link 16. Alternatively, tag 30 is mounted via a plunger mechanism to device 12, and is connected to communication link 16 simply by placing device 12 on a wire shelf configured to couple both wires across the tag.

Discussion of the Present Invention

Briefly stated, the present invention provides an alternative way of connecting a tag 30 of a device 12 to a network communication link 16 that combines the act of connecting device 12 to a power source (such as an AC power outlet) with the act of connecting tag 30 to communication link 16.

As discussed in detail below, in general, tag 30 is mounted to the AC plug of device 12 with which tag 30 is associated, either by embedding tag 30 into the plug or through the use of an adapter, and is accessible via one or more data contacts on the plug. On the network side, each communication link 16 is wired to an AC outlet and is engaged by the data contacts on the plug when the plug is inserted into the outlet. Thus, by connecting the plug with the outlet, the user simultaneously connects device 12 to a source of power and establishes a data path between tag 30 and the outlet (specifically, to network communication link 16).

With this invention, the user automatically connects tag 30 (and hence device 12) to network 14 simply by performing the well-practiced step of connecting device 12 to the power source (e.g., "plugging-in" the device). Connection to network 14 is thus totally transparent to the user and requires nothing on the user's part in addition to the normal act of plugging in device 12 (e.g., to recharge storage batteries). Because users typically are trained to plug devices 12 into an electrical power connector or perform this act as a matter of routine (even when devices 12 are placed in storerooms), the rate of compliance by device users is likely to be high, which translates into highly accurate device tracking using the techniques of the '929 application.

Figure 4:
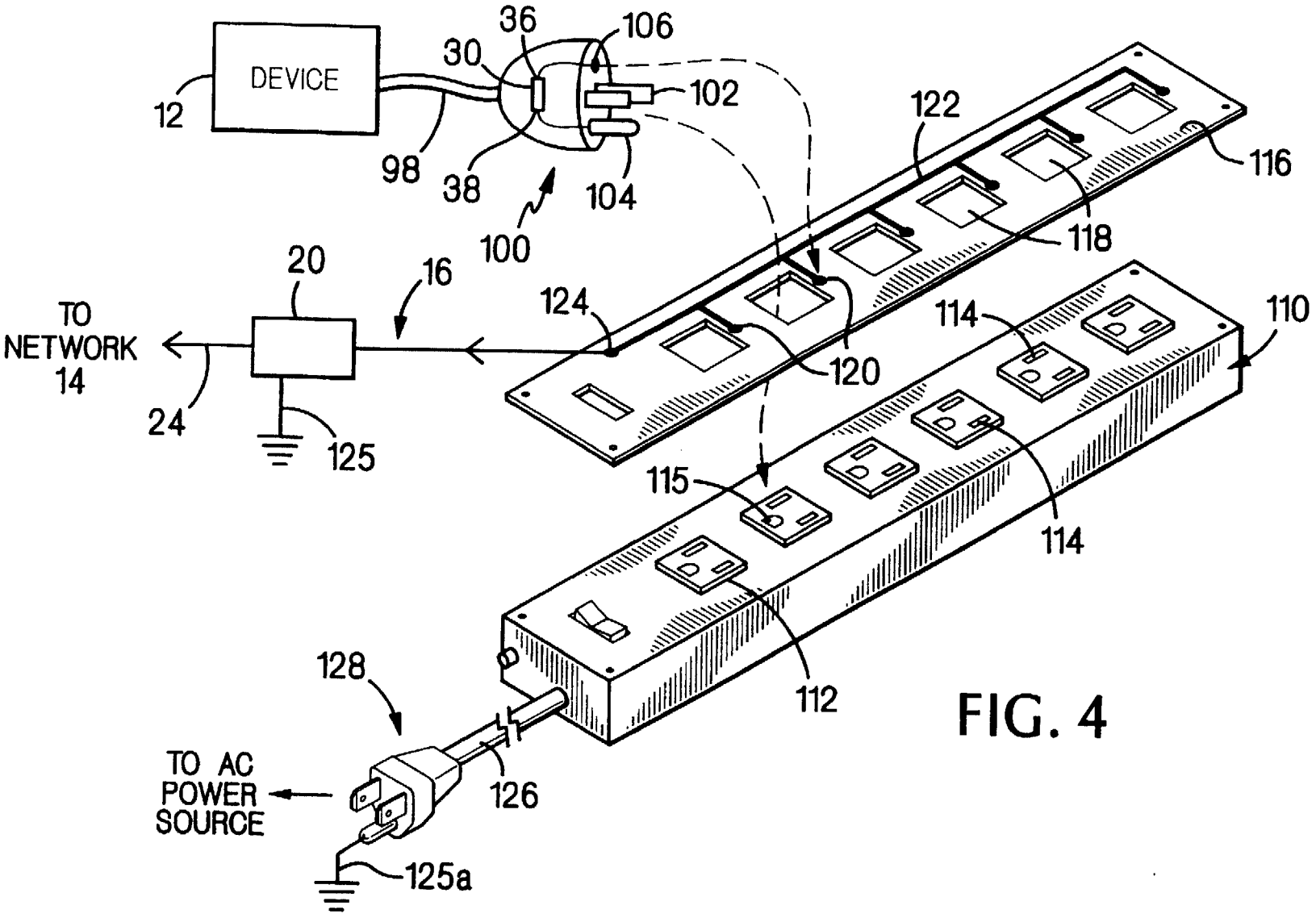
FIG. 4 illustrates an AC plug for connecting an electronic tag of a device to the network via the engagement of the plug with an AC power strip.

Referring to FIG. 4, the AC plug 100 of each device 12 is modified in any one of several ways (discussed below) to include a tag 30. As discussed below, tag 30 may either be mounted directly to or within plug 100 or may be connected to plug 100 via an adapter. In either case, the normal AC power connections between device 12 and blades 102 and ground pin 104 on plug 100 via cord 98 are not disturbed, and plug 100 retains the form and size of a standard AC plug, thereby remaining fully compatible with standard AC outlets. Data port 36 of tag 30 is connected to a data contact 106 (described below) mounted on the face of plug 100 to establish an electrical path to tag 30 that is separate from the AC connections provided by AC line and neutral blades 102 and ground pin 104. Ground pin 104 of plug 100 is electrically connected to tag data port 38.

Thus, a single accessory connection data contact 106) is added to a standard-configuration AC plug 100 to provide the interface to tag 30 and to allow data structure 32 and/or memory 33 (FIG. 2) to be accessed from outlet 110 using the aforementioned one wire protocol. In the configuration shown in FIG. 4, data contact 106 is positioned above and centered between AC blades 102, and is oriented opposite ground pin 104.

Various designs of AC outlets 110 are suitable for use with plug 100 (as well as with other embodiments of plug 100 discussed below). These designs include single AC outlets, duplex outlets, and multi-outlet power strips. Of these various designs, some are intended to permit use of plug 100 and alternative embodiments thereof with minimal modification to the receptacle, while others require that the receptacles be modified more extensively.

FIG. 4 shows an embodiment in which AC outlet 110 is a power strip containing a series of standard female AC sockets or receptacles 112, each of which includes a pair of AC terminals 114 and a ground terminal 115 configured to receive AC blades 102 and ground pin 104 of plug 100. Outlet 110 is fitted with a nonconductive plastic or plexiglas mask 116 having a set of apertures 118 for receiving receptacles 112. Mask 116 thus exposes receptacles 112 for connection to AC plugs 100. Typically, receptacles 112 are elevated slightly so as to be approximately coplanar with the upper surface of mask 116. For example, a model 4619 power strip, available from Waber Inc., in Mt. Laurel, N.J. has sockets elevated by 3/16" above the surface of the power strip, allowing sufficient room for mask 116.

Mask 116 includes a series of data contacts 120 spaced along a data wire 122 that is connected to communication link 16 at a data port 124. Data wire 122 is either etched on the upper surface of mask 116 or is laminated within mask 116. Communication link 16 is connected to network 14 via node 20 as discussed above and in the '929 application. Outlet 110 is equipped with a power cord 126 and plug 128 for connecting receptacles to a source of AC power (not shown) in the conventional way. Ground potential **125*a* for outlet 110 generally is the same ground potential 125 to which node 20 and the ground wire of communication link 16 are referenced, but the ground wire and potentials 125, 125*a*** may or may not be physically wired together.

Each data contact 120 is oriented with respect to AC terminals 114 and ground terminal 115 to ensure that a secure connection is made with data contact 106 when AC plug 100 is inserted into receptacle 112. Due to the three-pronged nature of AC plug 100, data contact 106 is automatically aligned with data contact 120 of mask 116 whenever plug 100 is properly inserted into receptacle 112. This allows tag-reading circuitry associated with node 20 to access data contact 106 via communication link 16 to exchange data with tag 30 (e.g., read tag data structure 32 or write data to tag memory 33—see FIG. 2).

Figure 5:
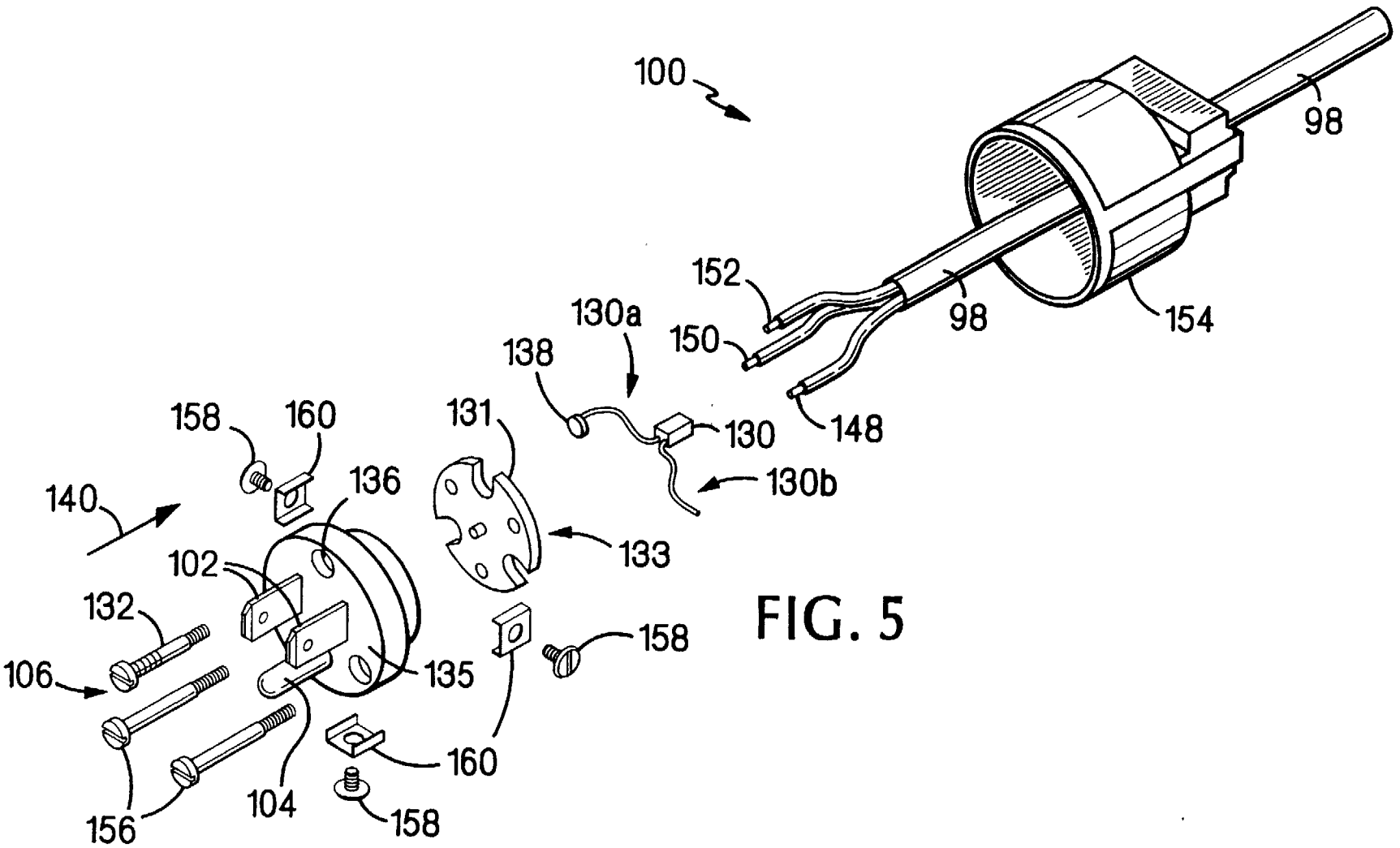
FIG. 5 is an exploded view of the AC plug of FIG. 4.

Referring to FIG. 5, the construction of an AC plug 100 that is modified to incorporate a tag 30 within it is shown. It will be appreciated that AC plug 100 contains both standard AC connections (i.e., line, neutral, and ground), as well as the connections to tag ports 36, 38, all integrally formed within a single housing 154. AC plug 100 thus is suitable for connection to any standard AC power cord 98 attached to a device 12.

In this embodiment, package 37 (FIG. 2) of tag 30 is in the form of a transistor package 130 (Dallas Semiconductor part no. DS2401) equipped with a pair of wires **130*a*, 130*b* which are electrically connected to tag data ports 36, 38 within package 130. Tag package 130 is fixed to a lower surface 131 of an insulating plate 133. Data contact 106 (FIG. 4) is provided by a metal screw 132 that passes through a hole 136 in the front face 135 of plug 100 and a corresponding opening in plate 133, and is secured to a nut 138 welded to wire 130*a***.

AC plug 100 also provides for connection of a ground wire 148, an AC neutral wire 150 and the AC line voltage wire 152 of power cord 98 to ground pin 104 and AC blades 102 in standard fashion. Wires 148–152 pass through openings in plate 133 for this purpose and are secured by screws 158 to respective clamps 160 that serve ground pin 104 and AC blades 102. In addition, wire **130*b* of tag housing 130 is connected to ground pin 104 and ground wire 148 by the connection between screw 158 and clamp 160 associated with ground wire 148. Housing 154 covers the entire plug assembly and threadably receives a pair of screws 156 which pass through front face 135. Plug 100 and its AC components (including plate 133, face 135, housing 154 and mounting hardware 1565, 158, 160**) are available from Eagle Corporation of Long Island City, N.Y.

The length of screw 132 and the position of tag housing 130 and wire **130*a* are such that the head of screw 132 protrudes slightly from plug face 135 when plug 100 is not engaged with an AC outlet. Wire 130*a* is sufficiently stiff to act as a leaf spring, resisting the depression of screw 132 into housing 154 (in the direction of arrow 140). Put another way, screw 132 is essentially a spring-loaded pin for engaging data contact 120 (FIG. 4). When plug 100 is inserted into a receptacle 112 of outlet 110, the head of screw 132 engages data contact 120 on mask 116 and, due to the slight protrusion of the screw head from plug face 135, is depressed in the direction of arrow 140. The resiliency of wire 130***a* resists the movement of screw 132 to provide a firm connection between screw 132 and data contact 120 on mask 116, thereby providing a positive, reliable connection between tag 30 and communication link 16.

Another advantage provided by spring-loading screw 132 is that screw 132 does not interfere with the normal insertion of plug 100 in any AC outlet—whether the outlet is equipped with a data contact 120, or not. The head of screw 132 retreats within hole 136 to allow plug face 135 be placed flush against the face of the outlet. Moreover, the resiliency of wire 130*a* is insufficient to overcome the force of the connection between the plug and outlet, and thus does not cause plug 100 to "back out" of the outlet.

Other Embodiments

Other embodiments are within the scope of the claims.

For example, the spring loading of screw 132 may be provided in other ways. One possibility is secure tag wire 130*a* in a fixed position and interpose a helical spring between the shaft of screw 132 and nut 138. Alternatively, screw 132 may be fixed rigidly in position, rather than being spring loaded. Data contact 120 can be recessed somewhat in the upper surface of mask 116 (FIG. 4), if desired, to allow plug 100 to be flush with the upper surface of mask 116.

Moreover, the spring-loaded component may be provided on the AC outlet 110 rather than on plug 100. For example, data contacts 120 of outlet 110 may each be implemented as a spring-loaded pin. In this case, plug 100 may include a female data contact 106—such as a socket—in place of the male pin shown in FIG. 5. Alternately, data contact 106 may be flush with the face of plug 100.

Of course, data contact 106 need not be positioned opposite to ground pin 104 between AC blades 102—any suitable radial or angular position may be used. In addition, multiple contacts 106 can used to provide additional accessory communications connections. Moreover, both data port connections to tag 30 may be positioned as discrete contacts which are entirely separate from AC blades 102 and ground pin 104. The connection between data contacts 106, 120 may be momentary, rather than continuous.

Figure 11:
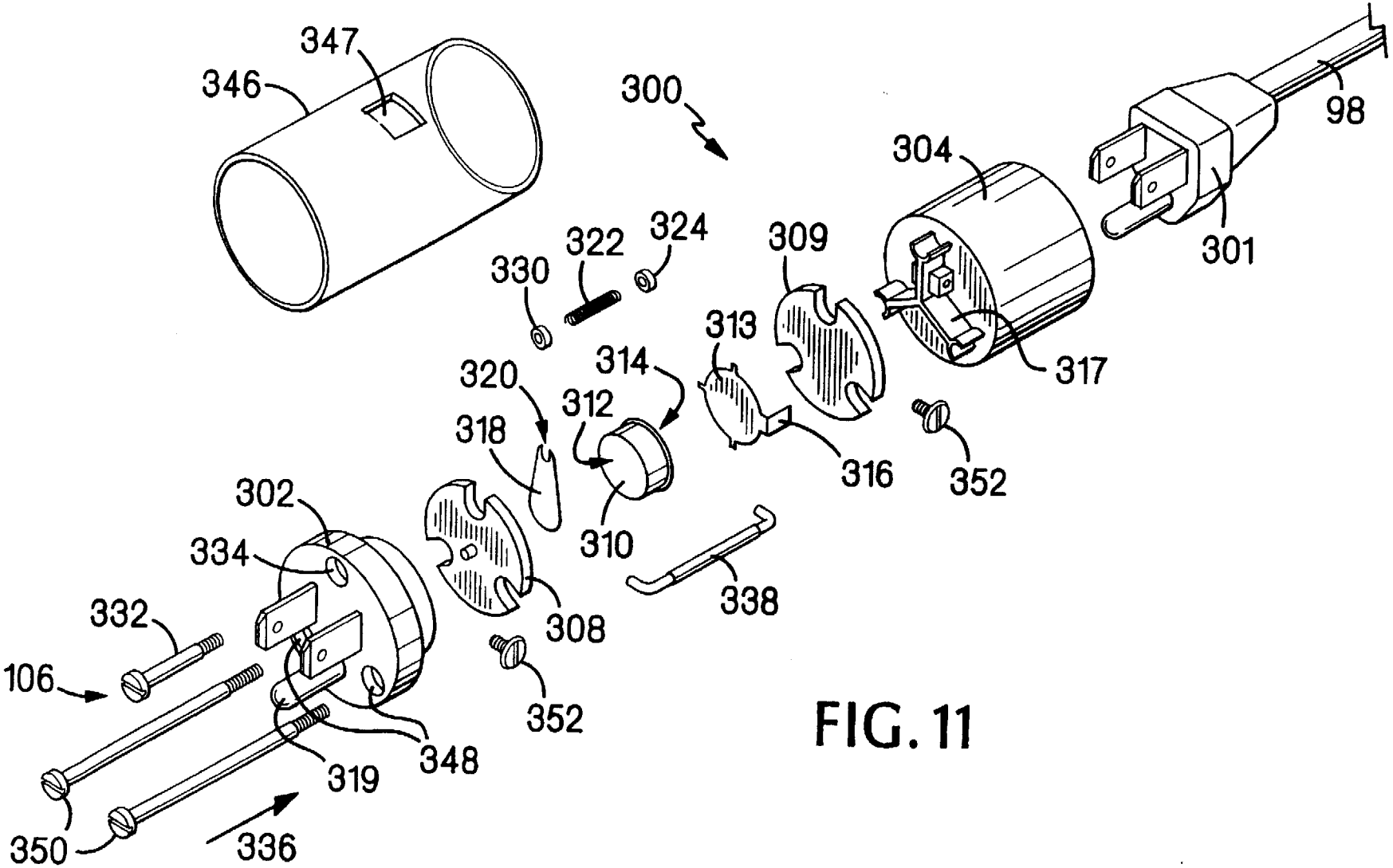
FIGS. 11 and 12 are exploded views of adapters for mounting an electronic tag to a standard AC plug.
Figure 12:
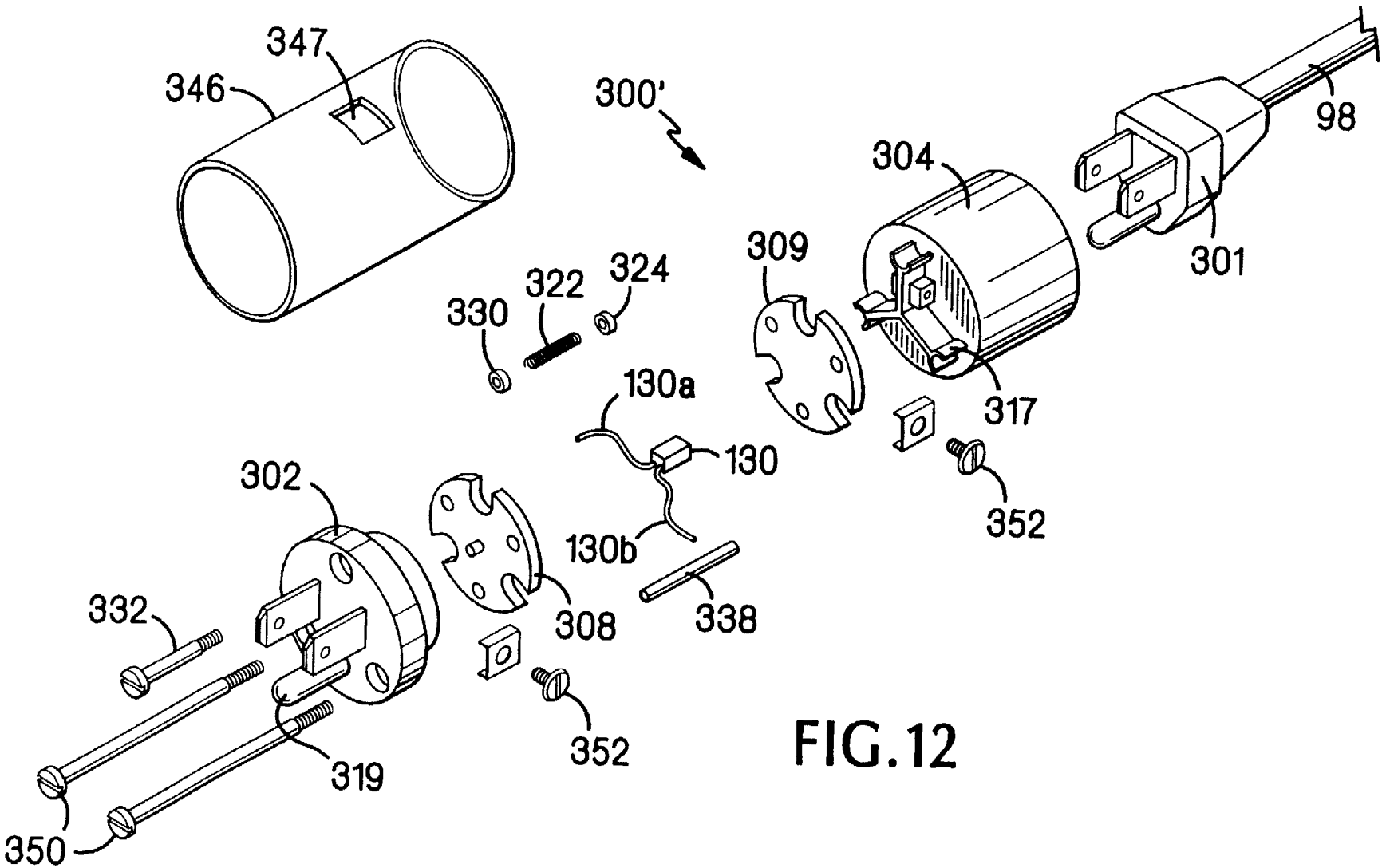

Tag 30 need not be physically located within the plug. Any suitable location will do. For example, tag 30 can be incorporated in power cord 98 or housed in device 12 itself, simply by suitably extending electrical connections to data ports 36, 38 (FIG. 2). As described in more detail below, tag 30 may be located in various places outside the housing of plug 100, or may be secured to the AC plug through an adapter (examples of such an adapter are shown in FIGS. 11 and 12). Moreover, communication link 16 may be wired to an outlet other than power strip 110.

Figure 6:
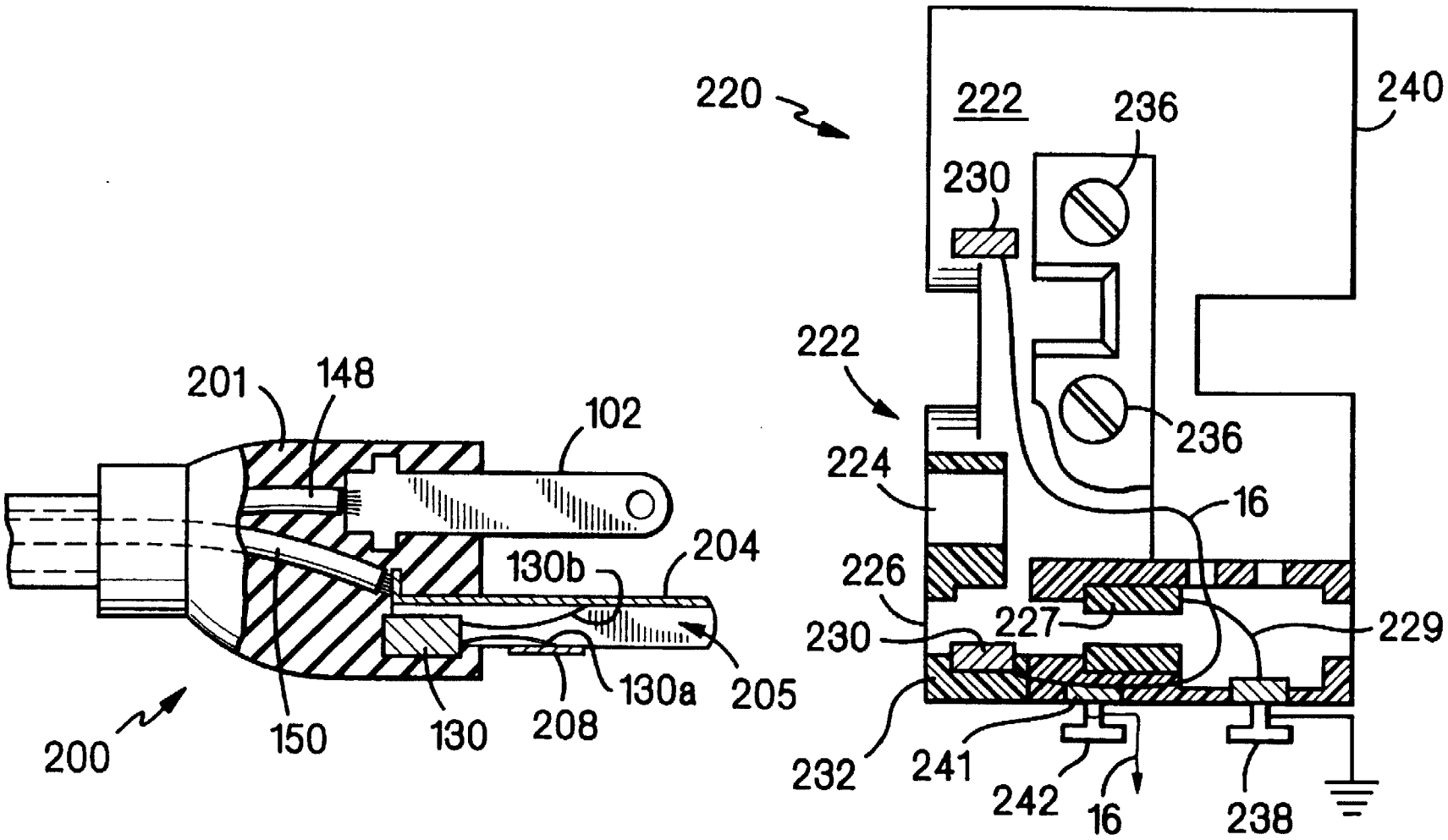
FIGS. 6–8 show an alternative embodiment of an AC plug and AC outlet for connecting an electronic tag of a device to the network.
Figure 8:
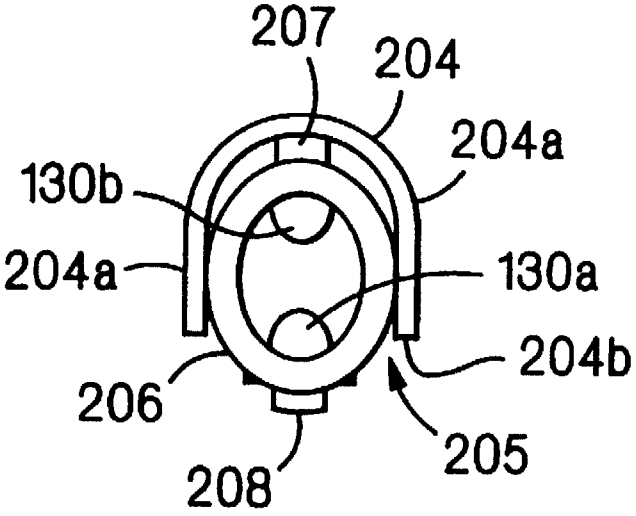
Figure 7:
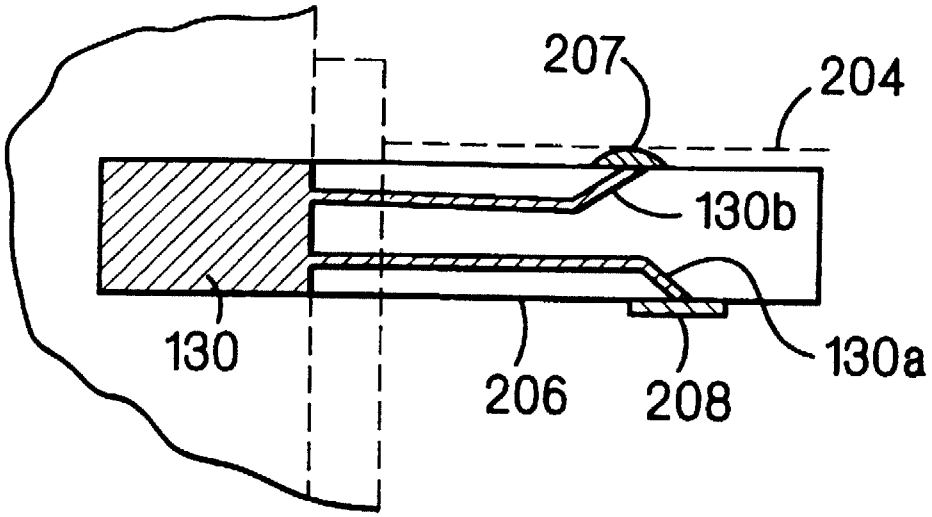

For example, referring to FIGS. 6–8, tag 30 (housed in transistor package 130, discussed above) is molded within a plastic AC plug 200 of the kind that has a hollow, U-shaped ground pin 204 centered beneath AC line and neutral blades 202. One example of such a plug 200 is an Eagle Corporation NEMA 5-15P hospital plug, available as part number 88020270 from Panel Components Corporation of Oskaloosa, Iowa. Wires 130*a*, 130*b* extend from the housing 201 of plug 200 into an elongated cavity 205 defined by ground pin 204 within suitable nonconductive medium 206, such as a hollow, compressible sheath (FIGS. 7 and 8) to insulate them from ground pin 204 while also providing secure attachment to ground pin 204. The free end of wire 130*b* is soldered or otherwise attached to an interior surface of ground pin 204 at ground contact 207. The free end of wire 130*a* is attached to a metal data contact 208 positioned outside of sheath 206. As shown by FIG. 8, contact 208 is insulated from, and approximately centered with respect to, the sides 204*a* of U-shaped ground pin 204 and is resiliently supported beyond ground pin edges 204*b*.

AC power cord 98 enters plug housing 201 in the usual way. AC line wire 148 and neutral wire (not shown) are fixed to blades 202 (only one of which is shown). Likewise, AC ground wire 150 is secured to ground pin 204.

AC outlet 220 includes a pair of sockets 222 (only one of which is shown in detail) each of which is configured to connect finger 208 (and hence tag 30) to communication link 16 and contact 207 to ground, as well as join AC blades 202 to AC terminals 224 and engage ground pin 204 with ground terminal 226 in the usual manner, when AC plug 200 is properly inserted therein. An example of a typical AC outlet that can be modified in this way is an Eagle Corporation NEMA 5-15R hospital grade socket, available as part number 88020290 from Panel Components Corporation of Oskaloosa, Iowa.

Ground terminal 226 is equipped with a data contact 230 mounted on a lower wall 232 of terminal 226 to engage finger 208 in a sliding fashion when ground pin 204 is inserted into receptacle 222. (Note that data contacts 208, 230 should be arranged to avoid short circuiting between data contact 230 and ground in the event that a plug that is not equipped with a data contact 208 on its ground pin is inserted in receptacle 222.) Communication link 16 is wired within wall 232 and electrically connected to data contact 230. Communication link 16 is also soldered 241 to a terminal 242, which provides an external connection to node 20 (not shown).

AC line and neutral terminals 224 are internally connected to lugs 236 on the sides of the outlet housing 240 in the usual way. Likewise, an AC ground connection is made between a contact 227 on terminal 226 and ground lug 238 via wire 229. Lugs 236, 238 are secured to the AC wiring of the facility in a conventional manner, and hence these connections are not shown.

Ground lug 238 provides the ground connection for the two wire communication link 16. Terminals 242 and lugs 238 of a series of outlets 220 may be wired together in a "party line" or "daisy chain" fashion so that a single communication link 16 can serve, e.g., all of the outlets 220 in a room or set of rooms. This embodiment is explored in detail below with reference to FIG. 13.

Figure 6B:
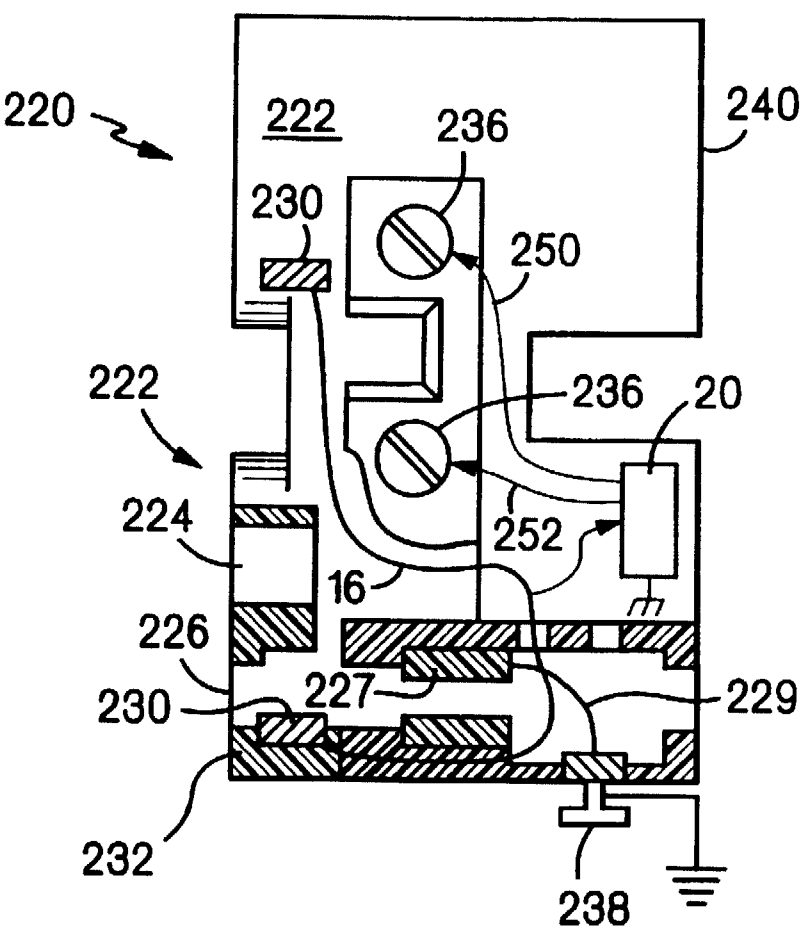
FIGS. 6A and 6B are alternative embodiments of the AC outlet shown in FIG. 6.
Figure 6A:
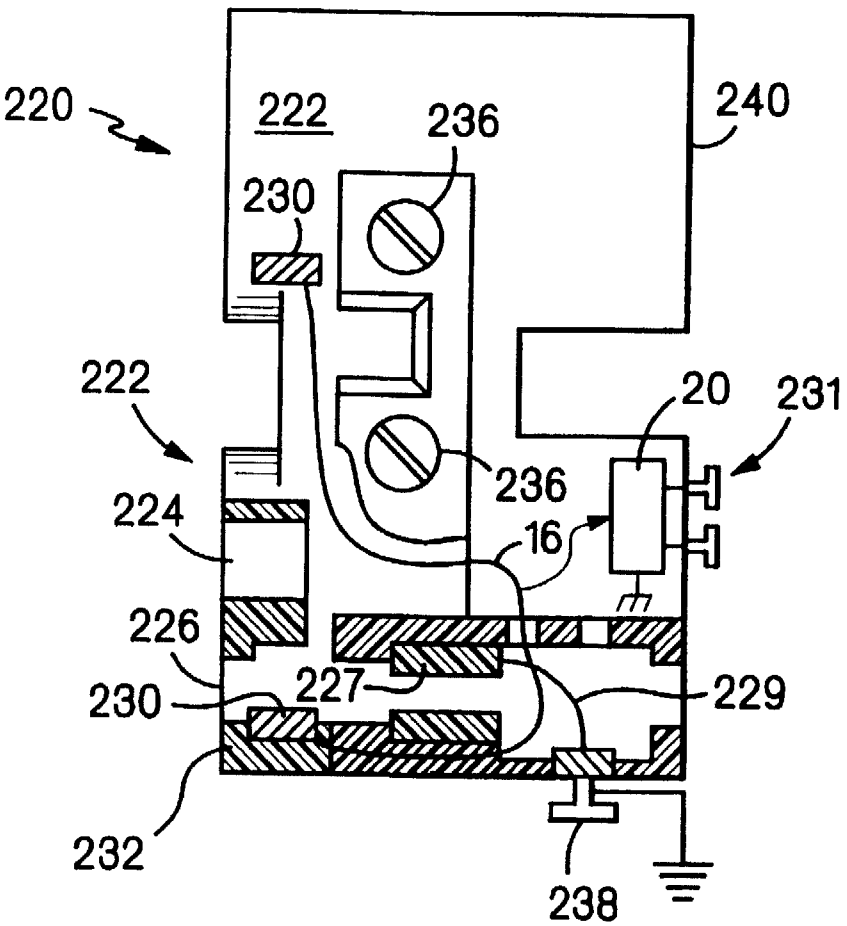

Referring to FIGS. 6A and 6B, alternately, node 20 may be mounted within outlet housing 240. In this case, an external connection for communication link 16 is not needed (although it certainly may be provided). In the embodiment shown in FIG. 6A, the outputs of node 20 are connected to a pair of terminals 231 on housing 240 for external access. FIG. 6B illustrates yet another embodiment, useful when node 20 is enabled to communicate over the AC power lines of the facility. An embodiment in which node 20 communicates over the AC power lines (i.e., the AC power lines serve as part or all of network 14) is described below. In this case, the outputs of node 20 are applied by a pair of wires 250, 252 to the AC line and neutral terminals 236 of outlet 220.

In any of the embodiments shown in FIGS. 6, 6A, or 6B, in use, as plug 200 is inserted into receptacle 222, metal finger 208 on ground pin 204 slides over and establishes an electrical connection with data contact 230 in ground terminal 226. Sheath 206 compresses radially during insertion, and returns to its original, expanded configuration when plug 200 is fully inserted. As a result, sheath 206 urges metal finger 208 firmly against data contact 230. This establishes a secure electrical connection between tag wire 130*a* and communication link 16. Tag wire 130*b* is firmly connected to ground through the secure engagement of pin 204 and terminal 226. Thus, during operation, node 20 communicates with tag 30 in the same manner as described elsewhere in this application and in the '929 application via communication link 16.

Figure 9:
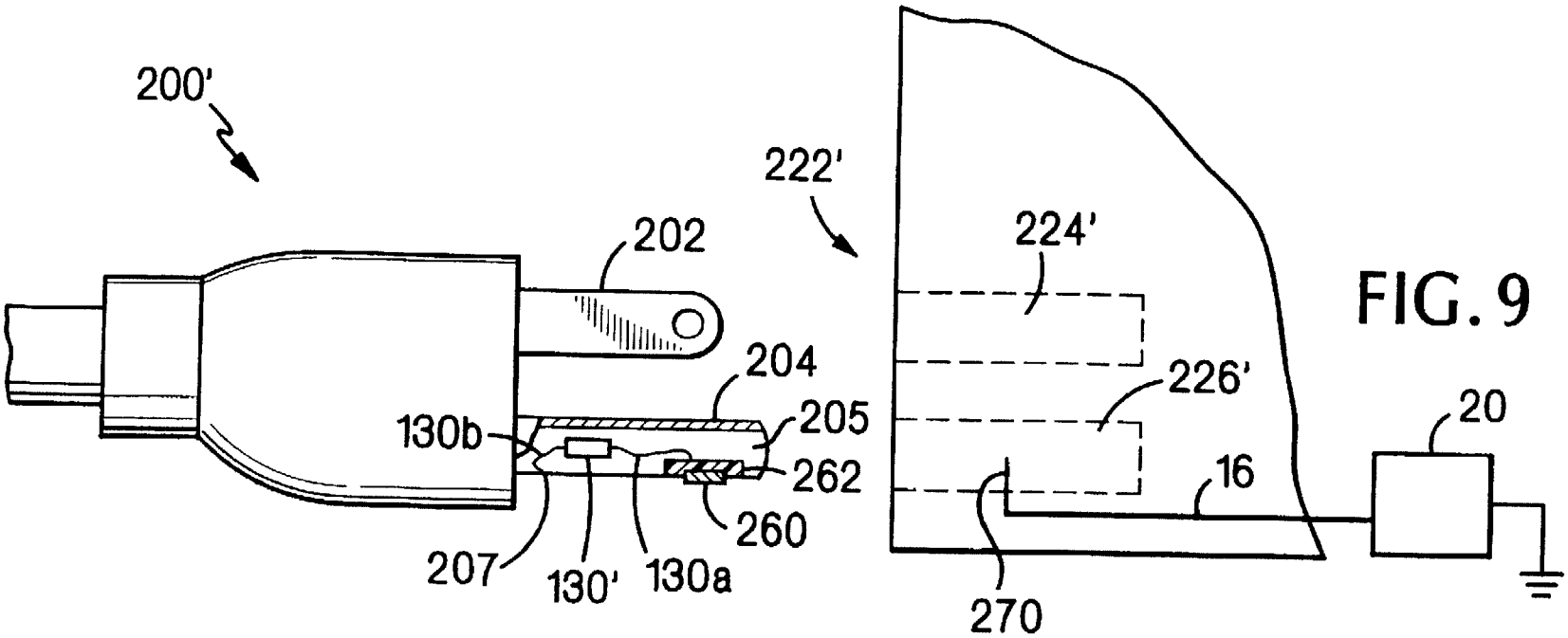
FIGS. 9 and 10 illustrate a modification to the AC plug and AC outlet of FIGS. 6–8.
Figure 10:
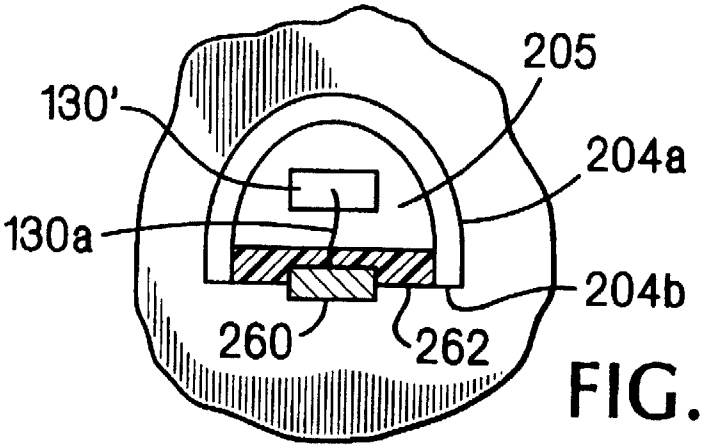

Referring to FIGS. 9 and 10, tag 30 can alternatively be mounted within cavity 205 of ground pin 204, rather than within the plug housing. AC plug 200' has such a configuration. In this case, tag package 130' is an integrated circuit (e.g., a Dallas semiconductor DS1990a, or an alternative component with similar functionality) suitable for surface-mount applications on miniature printed circuit boards (the approximate dimensions of package 130' are 0.100 inches in length X 0.062 inches in width X 0.040 inches in height). Tag contact 130*a* is connected to an elongated conductor 260 encased within a suitable nonconductive medium 262 (such as an epoxy body) that is bonded to sides 204*a* of ground pin 204. Tag contact 130*b* is grounded to an interior surface of ground pin 204. Tag wires 130*a*, 130*b* are insulated to avoid short-circuiting to each other or to ground pin 204.

Mounting medium 262 insulates conductor 260 from ground pin 204 and, together with the connections of wires 130*a*, 130*b*, holds tag package 130' in place within cavity 205. Conductor 260 is positioned so that its lower surface protrudes slightly beyond the plane defined by the edges 204*b* of sides 204*a*.

Receptacle 222' used in conjunction with plug 200' includes a data wire 270 supported vertically within ground terminal 226'. Data wire 270 is connected to node 20 (which can be mounted within or externally to receptacle 222') by communication link 16, which is mounted within a lower wall of receptacle 222' in a manner similar to that shown in FIG. 6. Data wire 270 protrudes into ground terminal 226' only by an amount sufficient to contact conductor 260. Wire 270 is resilient and thus bends as plug 200' is inserted and returns to the vertical orientation when plug 200' is withdrawn. Of course, other techniques may be used to provide a suitable electrical connection between data contact 270 and conductor 260.

Thus, in use, as plug 200' is inserted in receptacle 222' conductor 260 makes a brushing contact with data wire 270, thereby connecting tag 30 to communication link 16. The ground connection to wire 130*b* is made in the same manner as described above for FIG. 6.

Any plug 200, 200' with hollow ground pin 204 is thus easily modified for communication over network 14 simply by placing tag package 130' and conductor 260/mounting medium 262 assembly in cavity 205 of ground pin 204 and making the signal and ground connections described above.

The plug need not have a U-shaped ground pin 204. For example, plug 200' may have a ground pin 204 with a circular cross-section. In this case, tag package 130' (or 130) is placed in an insulating sheath (such as sheath 206, FIG. 8) and inserted into cavity 205 during the assembly of plug 200'. Tag wire 130*a* is passed through a small hole in sheath 206 and soldered to a metal region on the underside of ground pin 204 that is insulated from the remainder of ground pin 204 (e.g., by a ring of plastic) to provide an electrical path to data port 36 of tag 30 (FIG. 2). Tag wire 130*b* (and thus tag data port 38) passes through a second opening in sheath 206 and is connected to another, grounded region of pin 204, as discussed above relative to FIGS. 6–8.

A common requirement for the embodiments in which the ground pin is used to connect tag data ports 36, 38 to the communication link and ground is that the data wire (e.g., 270) must not short to an unmodified ground pin (e.g., 204) which does not contain components (such as 260, 262 or 130, 130*a* or 130*b*), or to a cylindrical ground pin, such as that shown protruding from plug housing 301 in FIGS. 11 and 12.

Referring to FIG. 11, an adapter 300 that contains a tag 30 is used to retrofit an ordinary AC plug 301 with tag 30. Adapter 300 includes a male AC plug 302 at one end for insertion into any of the receptacles discussed in this application, and a female AC socket 304 at an opposite end for receiving plug 301 attached to a power cord 98 of a device 12 (not shown). Plug 301 is glued to socket 304 if adapter 300 (and hence tag 30) is to be permanently associated with plug 301.

Tag 30 is mounted in a metal, can-shaped package 310 described below and in the '929 application) the upper surface 312 and lower surface 314 of which provide electrical connections to data ports 36, 38 (FIG. 2). Package 310 is sandwiched between a front support plate 308 and a rear support plate 309. Plates 308, 309 are maintained in position with respect to male AC plug 302 and AC socket 304 by screws 350.

A thin metal ground plate 313 positioned between tag package 310 and support plate 309 contacts lower surface 314 of package and is rigidly connected by a tab 316 to ground terminal 317 of socket 304. A thin metal signal plate 318 is captured between package 310 and support plate 408 and is in electrical contact with surface 314 of package 310. A helical spring 322 is soldered to a free end 320 of signal plate 318, which is notched to receive spring 322. One end of spring 322 is attached to a nut 324, which in turn is permanently fixed to socket 304. The opposite end of spring 322 is attached to a second nut 330, which threadably receives a screw 332.

The AC line and neutral connections and the ground connections between adapter plug 302 and socket 304 are made by insulated wires 338 (only one of which is shown) the ends of which are secured by screws 352 and clamps (not shown) in the usual manner. In particular, note that ground terminal 317 of socket 304 (to which tag data port 38 is connected via plate 313 and tab 316) is electrically connected to ground pin 319 of plug 302.

Adaptor 300 is assembled by placing all internal components in a housing 346 as discussed above, and fitting the ends of the housing with male plug 302 and socket 304 using an adhesive. Holes 334, 348 in male plug 302 are aligned with notches in support plates 308, 309. Screws 350 are passed through apertures 334, 348 and support plates 308, 309 and are threaded into socket 304 to securely hold the internal components together. Housing 346 may be provided with an access port 347 (e.g., a portion of housing 346 that can be removed) for exposing tag package 310 and allowing it to be removed and replaced with an new (or repaired) tag 30 without disassembling adapter 300. An example of an AC plug adapter that can be modified to serve as adapter 300 (i.e., with tag 30 mounted therein) is a NEMA 5-15R in-line connector, manufactured by Eagle Corporation and available as part number 88020280 from Panel Components Corporation.

The lengths of screw 332 and spring 322 are such that the head of screw 332 protrudes slightly from an aperture 334 in the face of male plug 302—thus, it will be appreciated that screw 332 serves as a spring-loaded pin for connecting tag 30 to, for example, a data contact (FIG. 5) of a communication link 16. When adapter 300/plug 302 are installed in, e.g., receptacle 112 of outlet 110 (FIG. 5), screw 332 is pushed into adapter 300 (that is, in the direction indicated by arrow 336). Spring 322 compresses against the motion of screw 332, thereby firmly establishing the electrical connection between screw 332 and data contact 120.

Referring to FIG. 12, an alternative plug adapter 300' houses a transistor-type tag package 130 of the kind shown in FIG. 5. Tag wire 130*a* is soldered to spring 322 at approximately the midpoint thereof. Tag wire 130*b* is electrically connected to the conductor of insulated wire 338 that joins ground leads 317, 319 of adapter plug 302 and socket 304. The assembly of adaptor 300' is otherwise identical to the assembly of adaptor 300.

As an alternative, tag wires 130*a*, 130*b* may be removably connected to spring 322 and wire 338 (e.g., in a pin-in-socket manner) to allow tag package 30 to be removed and replace. Housing 346 may be provided with an access port 347 for this purpose.

As yet another alternative, spring 322 may be eliminated, and the resiliency of tag wire 130*a* relied upon to spring-load screw 332. This construction is discussed above with reference to FIG. 5.

Still other plug configurations are within the claims. Indeed, a variety of plugs other than an AC power plug can be modified for use with the invention. For example, line power wiring plugs conforming to standards of other countries can be fitted with tags 30 according to the invention.

AC outlets other than those discussed thus far may be used with the tag-equipped AC plugs described herein.

Figure 13:
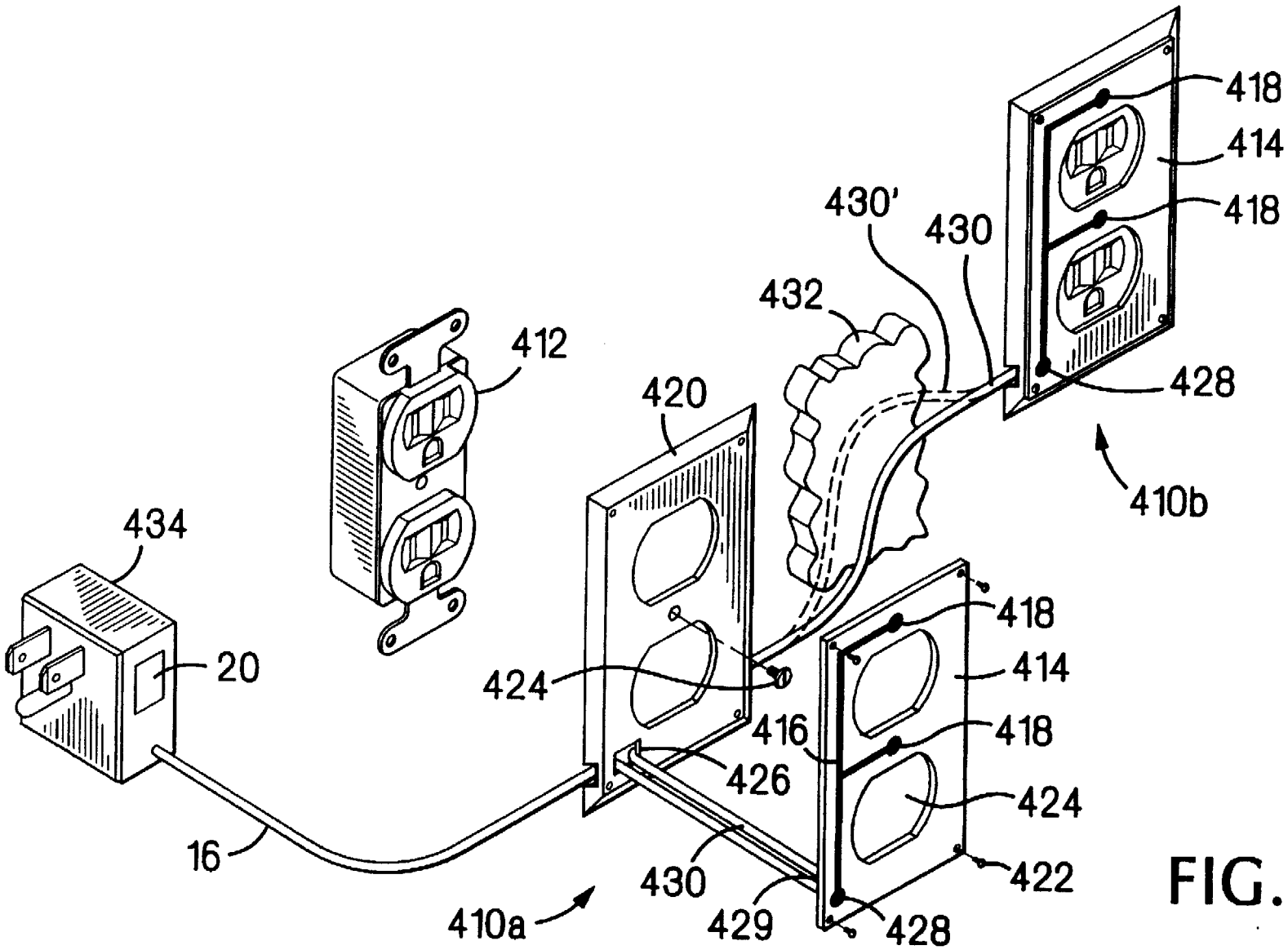
FIGS. 13–15 show alternative embodiments of AC outlets connected to a communication link of the network.

For example, FIG. 13 shows a pair of AC outlets 410*a*, 410*b* (generally referred to as 410) for connecting tags 30 of plugs (not shown) inserted therein to a communication link 16 connected between outlets 410*a*, 410*b* in "daisy-chain" fashion. (It will be appreciated that more, or fewer, outlets 410 can be connected to communication link 16 in this manner.)

Each outlet 410 is retrofitted for connection to communication link 16—the receptacle assemblies 412 (only one of which is shown) of outlets 410 are not modified in any way. Instead, a thin plastic mask 414 (similar to mask 116 of FIG. 4) that includes a pattern of conductive traces 416 which terminate in a pair of data contacts 418 is mounted to outlet faceplate 420 by four corner screws 422. A pair of apertures 424 in mask 414 expose the plug apertures of faceplate 420 (which is mounted to receptacle assembly 412 in the usual way, by a screw 424). Mask 414 covers screw 424 to avoid potential contact between trace 416 or contact 418 and screw 424, as well as all other pathways to ground. Data contacts 418 are positioned above each aperture 424 in the same way that contacts 120 are positioned on mask 116 (FIG. 4).

Communication link 16 is wired through a small hole 426 in the corner of faceplate 420 and connected to terminal 428 of trace pattern 416 on rear surface 429 of faceplate 420. Hole 426 may be cut in a standard faceplate 420; alternately, hole 426 (or a punchout therefor) may be formed during manufacture of faceplate 420. An extension 430 of communication link 16 is wired from terminal 428, through hole 426 to the next outlet (e.g., 410*b*) in the chain. A service loop in communication link 16 and extension 430 provides easy axis to terminal 428 for servicing. Extension 430 may be secured by adhesive-backed tape along the outer surface of a wall 432 on which outlets 410 are mounted, or, if desired, can be hidden from view behind wall 432 (this is shown by extension 430' in dashed lines).

In use, when an AC plug equipped with a tag 30—for example, plug 100 of FIGS. 4 and 5—is inserted into a receptacle 412, data contact 106 (e.g., the head of screw 132) engages the corresponding data contact 418 on mask 414, thereby connecting tag 30 to communication link 16, and thus to node 20. In embodiments (discussed below) in which network 14 includes the AC power lines of the facility, node 20 is mounted, for example, within an AC housing 434 that is inserted in another AC outlet (not shown) to enable node 20 to communicate with host computer 60 (FIG. 1).

Figure 15:
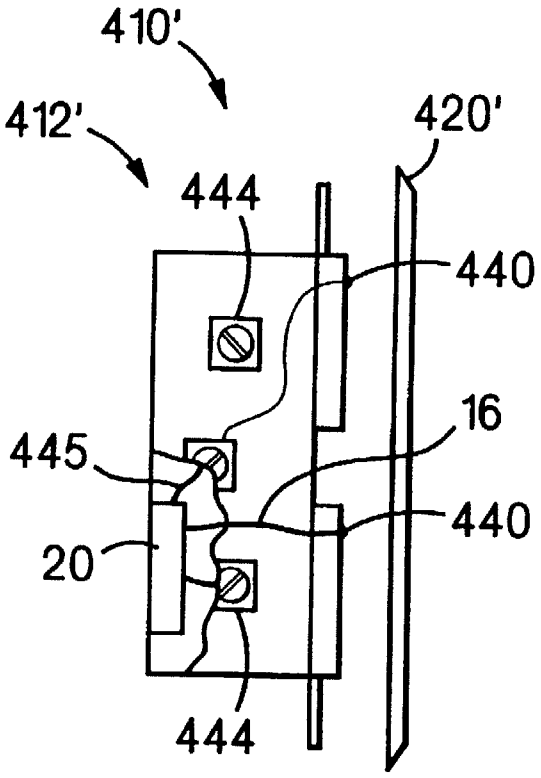
Figure 14:
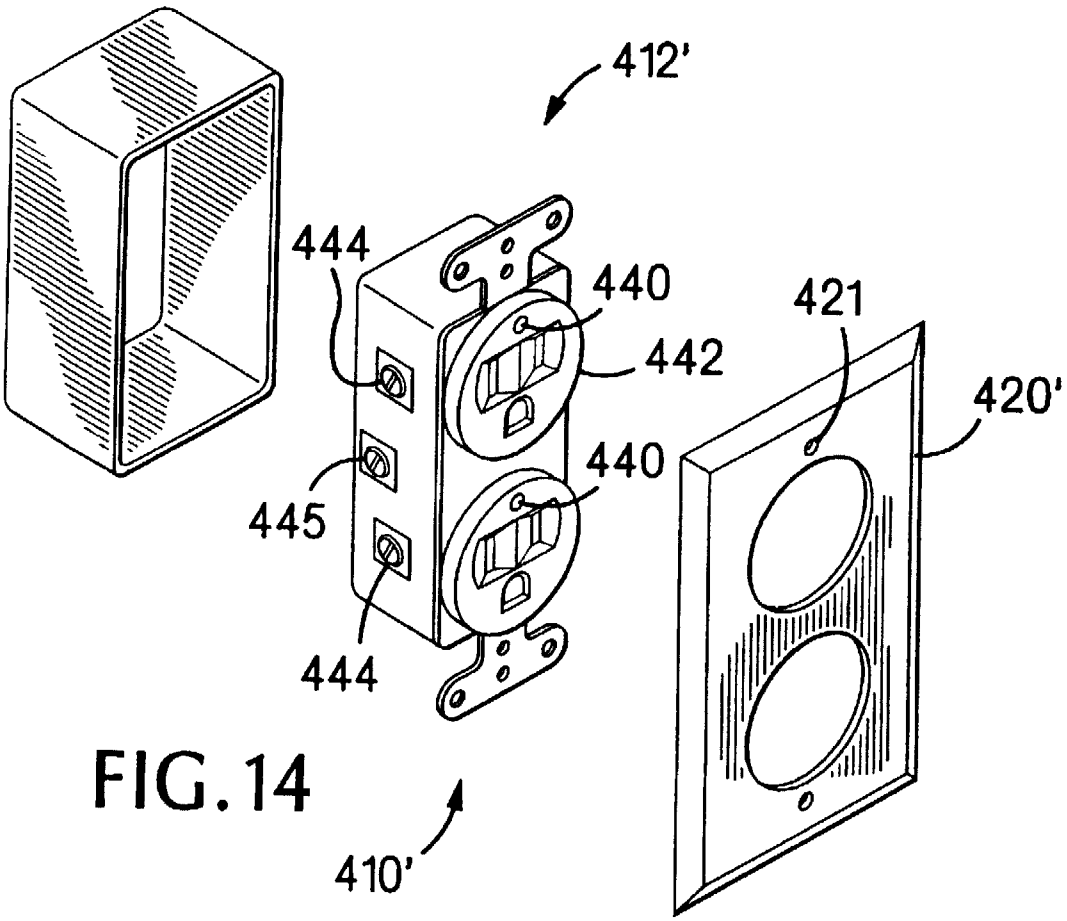

Referring to FIGS. 14 and 15, outlet 410' includes receptacle assembly 412' modified to include node 20 therein. In addition, receptacle assembly 412' includes a pair of data contacts 440 connected to node 20 through communication link 16. Each data contact 440 is a metal pin that is positioned above an individual receptacle 442 and protrudes through a corresponding hole 421 in faceplate 420+. Data contacts 440 are flush with the outer surface of faceplate 420' for engagement with a data contact of a tag-equipped AC plug (e.g., contact 106 of plug 100—FIG. 4).

If the AC power lines of the facility are used in network 14, the outputs of node 20 are connected to AC line terminals 444 and ground terminal 446 (as needed) of receptacle assembly 412'. Node 20 is also grounded to terminal 445. (The connections to the AC power line that serves outlet 410' are not shown.)

Of course, outlet 410' may be daisy-chained to other outlets (e.g., outlets configured similarly to outlet 410' but not equipped with a node 20, or outlets 410 shown in FIG. 13) by providing an external contact for communication link 16 (as shown in FIG. 6). This enables node 20 in outlet 410' to serve multiple devices 12 in a so-called "multi-drop" configuration.

Figure 16:
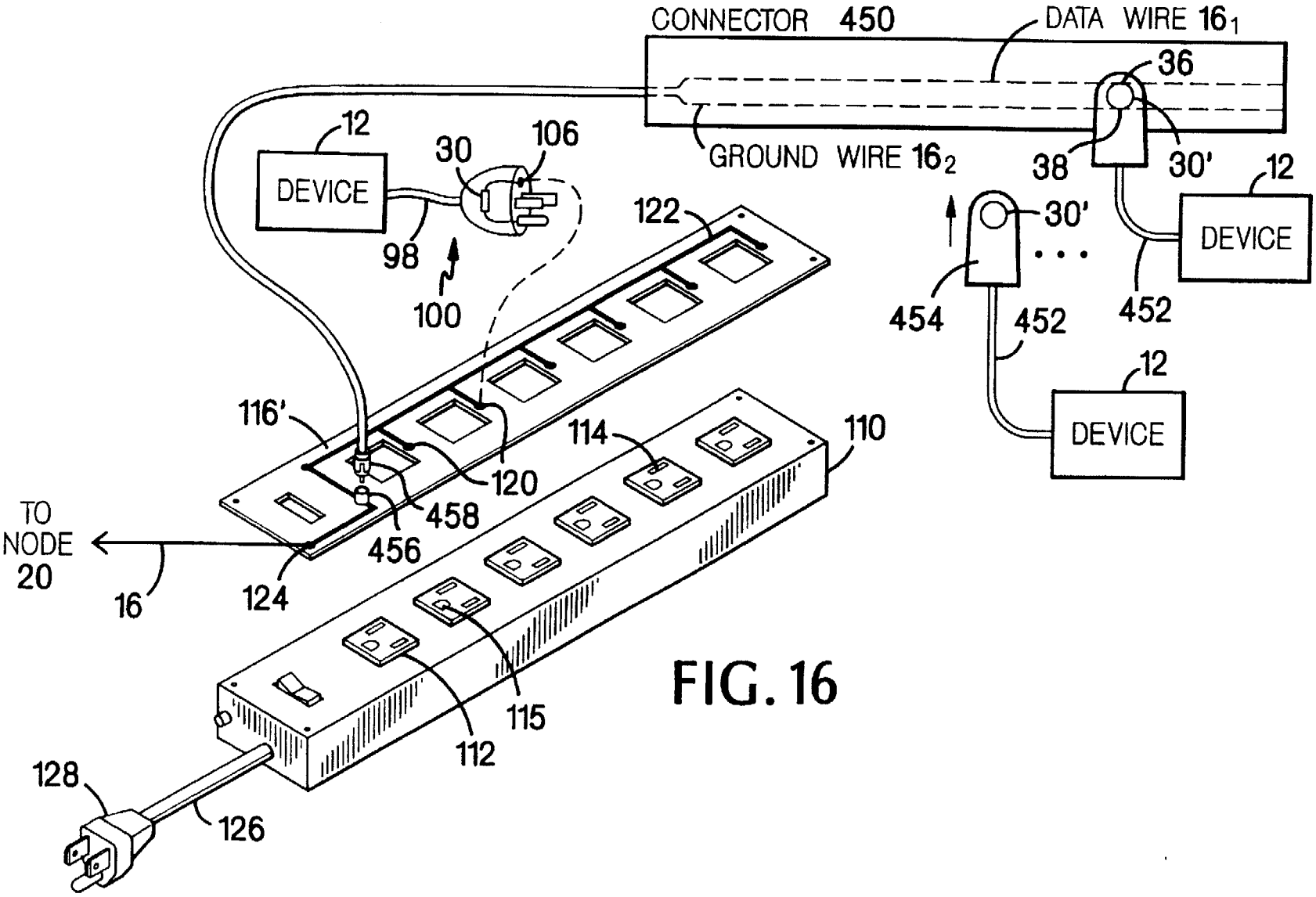
FIG. 16 illustrates the use of an AC outlet with a non-AC, auxiliary connector, both of which serve one or more communications links of the network.
Figure 17:
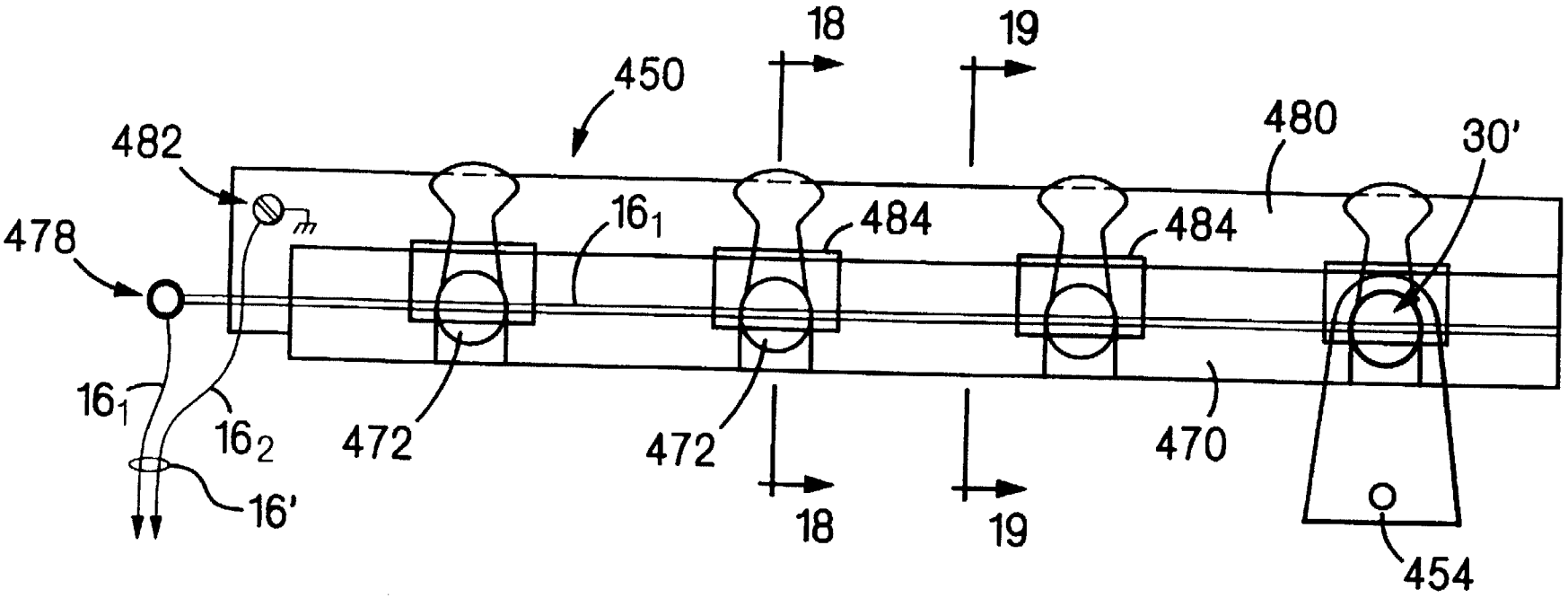
FIGS. 17–19 show an auxiliary connector in detail.
Figure 18:
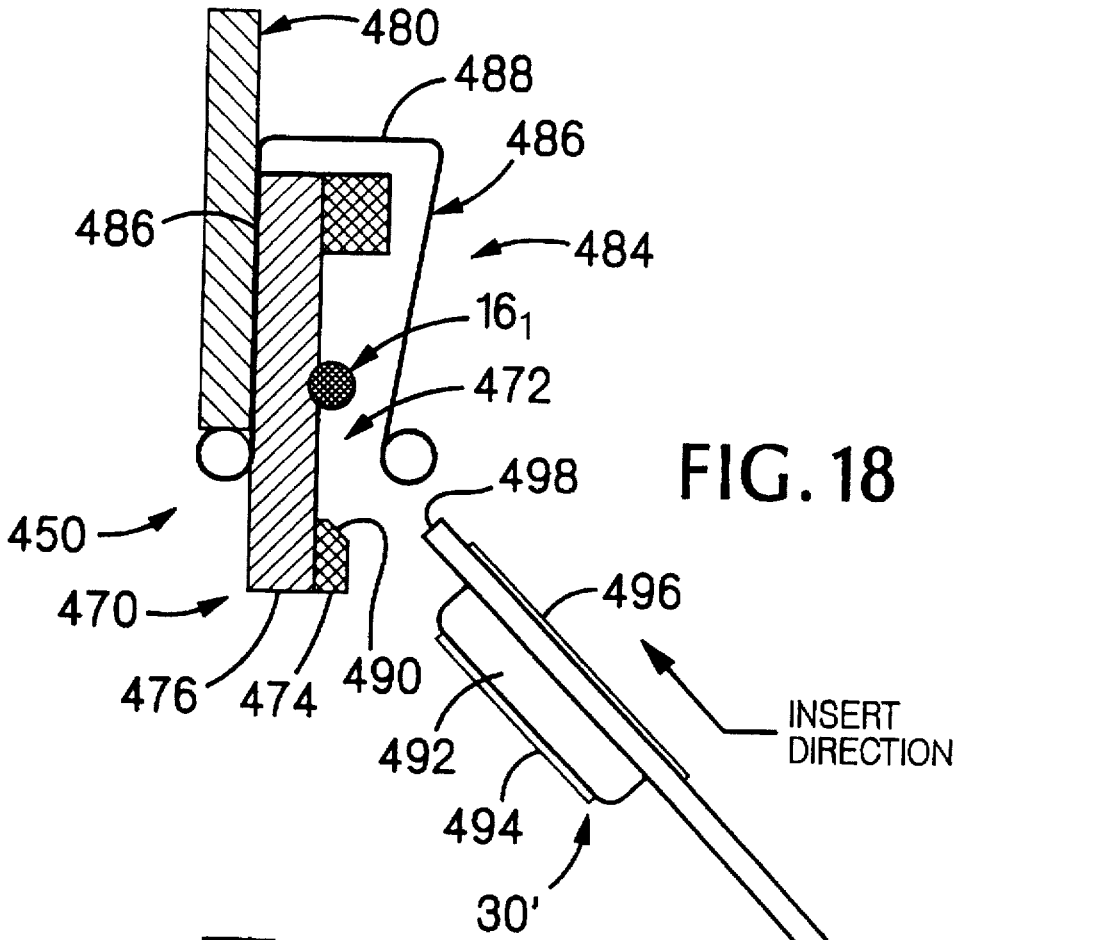
Figure 19:
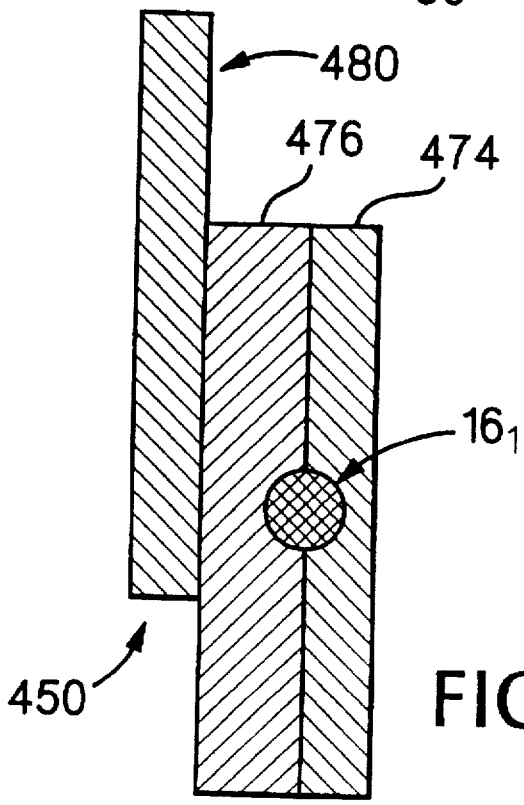

Referring to FIG. 16, any of the AC outlets described herein configured to receive a tag-equipped AC plug and connect tag 30 to a communication link 16 (for example, outlet 110) may also be used with one or more auxiliary, non-AC power connectors 450 for receiving tags 30. Some examples of auxiliary connectors 450 are described in the '929 application and have been summarized above. Another example of an auxiliary connector 450 is shown in FIGS. 17–19 and described below.

In general, auxiliary connector 450 is used with tags 30' that are tethered to devices 12 by non-electrical cables 452 (e.g., wire or plastic cords that are secured to the housings of devices 12). Typically, tags 30' are mounted in a metal housing that provides access to data ports 36, 38 (such as housing 492 described above and shown in FIG. 18 below) and that is secured to a plastic or other non-conductive card 454 secured to tether 452. Securing tag 30'/card 454 to connector 450 connects data ports 36, 38 across the pair of wires $16_1$, $16_2$ of an extension 16' of communication link 16.

Mask 116 and outlet 110 are modified from the configuration shown in FIG. 4 to include a connector 456 for receiving a compatible connector 458 on communication link extension 16'. Connectors 456, 458 are, for example, a female phono jack and a male phono plug, respectively. When connectors 456, 458 are engaged, data wire $16_1$ of extension 16' is connected to data wire 122, and thus to node 20 via communication link 16. In addition, an insulated feed 460 is provided through mask 116 and the housing of outlet 110 to connect data wire $16_2$ to the common ground connection used by receptacles 112 and plug 128.

In the configuration shown in FIG. 16, tags 30' are connected by extension 16' to the same communication link 16 (and thus the same port 22 of node 20) to which tags 30 are connected by the engagement of plugs 100 and receptacles 112. If desired, however, communication link extension 16' may be connected to a different port 22 of node 20, simply by providing a separate port on mask 116 for jack 456. Among other advantages, this would allow host computer 60 to distinguish between devices 12 connected to outlet 110 from devices 12 linked to connector 450.

Referring to FIGS. 17–19, auxiliary connector 450 includes an elongated board 470 that includes a series of axially spaced, circular slots 472, each of which is sized to receive a tag 30' on a card 454. Board 470 is comprised of two strips 474, 476 of plastic that are laminated together (FIG. 19) and capture therebetween data wire $16_1$ of communication link extension 16', which is received at terminal 478 and extends along the length of board 470. Slots 472 are formed in strip 474 to expose wire $16_1$. Wire $16_2$ of communication link extension 16' is electrically connected to a metal backplane 480 which is in turn grounded at ground terminal 482.

A series of metal spring clips 484 are mounted between board 470 and backplane 480, with one of the resilient edges 248 of each clip 484 being aligned with each slot 472. Spring clips 230 are 16 mm, ⅝" medium SKU 103549 binder clips, available from Staples Corporation of Framingham, Mass. Each clip 484 is glued to the rear surface of strip 476 and is soldered to backplane 480, which extends above the upper surface 488 of each clip 484 to provide additional support for clips 484.

Strip 474 is beveled 490 at the lower edge of each slot 472 to ease insertion of tag 30' and card 454 in the orientation shown in FIG. 18. Tag 30' is contained in a metal housing 492 of the kind described above and in the '929 application. Tag data ports 36, 38 (FIG. 2) are in electrical contact with upper and lower surfaces 494, 496, respectively, of housing 492.

Tag 30' is inserted into slot 472 by orienting tag housing 492 and card 454 so that surface 494 faces connector 450, inserting the front edge 498 of card 454 under clip 484, and then sliding housing 492 over edge 490 into slot 472. As tag housing 492 is inserted, card 454 forces front edge 486 of clip 484 away from board 470. When tag housing 492 is fully inserted in slot 472, clip 484 springs back towards board 470 to firmly engage memory surface 496 of tag housing 492 and hold card 454 in place.

The resiliency of clip 484 firmly holds tag housing 492 in place in slot 472 so that surface 494 is fixed against data wire $16_1$. Front edge 486 of clip 484 establishes a secure electrical connection with ground plane 480 (and hence wire $16_2$) via the electrical path provided by metal clip 484. Thus, tag 30' can be accessed by node 20 in the manner discussed above and in the '929 application via communication link extension 16'.

Figure 20:
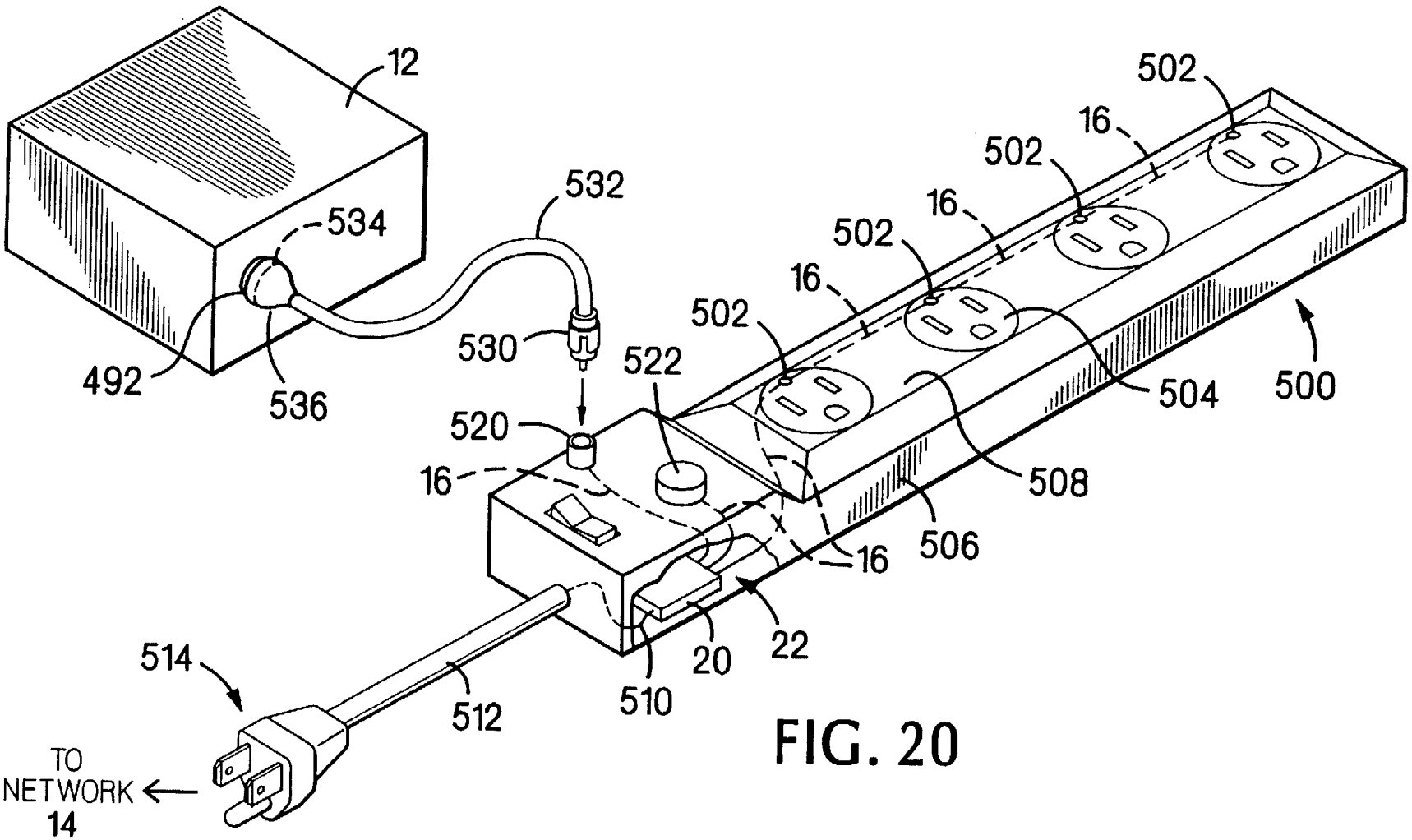
FIG. 20 shows an AC outlet used with other non-AC, auxiliary connectors, all of which serve one or more communication links of the network.

Referring to FIG. 20, still other types of AC connectors and auxiliary connectors may be used. AC outlet 500 is similar to power strip 110 (FIG. 4) in that outlet 500 provides a set of data contacts 502 for engaging data contacts 106 of tag-equipped AC plugs 100 (FIG. 4) that are inserted into receptacles 504. In this embodiment, however, communication link 16 extends through the housing 506 of outlet 500 to a set of data contacts 502 disposed on the upper surface 508 of housing 506 at each receptacle 504. In addition, node 20 is disposed within housing 506 and receives communication link 16 at one of its ports 22. Node 20 communicates over the AC power lines of the facility (which serve as network 14, not shown), and is discussed in more detail below. Thus, outputs 510 of node are connected to the AC power wires of power cord 512 and the AC power blades of plug 514 for connection to network 14.

Outlet 500 includes two additional auxiliary connectors 520, 522, each of which is connected via a communication link 16 to a port 22 of node 20. Auxiliary connectors 520, 522 and data contacts 502 may be connected to the same node port 22, or they may be linked to different node ports 22 through their own communication links 16 (as shown), or to any selected combination of node ports 22.

Auxiliary connector 520 is, for example, an RCA female phono jack of the kind discussed above. A connector of this sort is particularly useful for a device 12 on which a tag housing 492 (FIG. 18) is permanently mounted. Examples of such a device 12 include such non-AC powered devices as pacemakers, DC or battery powered machines, or mechanical devices such as wheelchairs. Tag 30 (not shown) in housing 492 is read by a touch-and-hold probe 534 (available from Dallas Semiconductor) held by a plastic grip 536 on the end of a two-wire cord 532. A phono plug 530 on the opposite end of cord 532 mates with auxiliary connector 520. Probe 534 includes a snap and hold fastener that securely grips tag housing 492 and connects tag data ports 36, 38 to the wires of cord 532, and thence to communication link 16 and ground, respectively, in outlet 500 via the connection between plug 530 and auxiliary connector 520.

Auxiliary connector 522 is a badge reader configured to read a tag 30 mounted via housing 294 (FIG. 18) on an employee ID badge. One example of such a badge reader is a DS 9092 Touch Probe available from Dallas Semiconductor. Among other advantages badge reader 522 allows a user to enter an employee identification number (i.e., data structure 32 of tag 30) into system 10 whenever he or she connects a device 12 to outlet 500.

Figure 21:
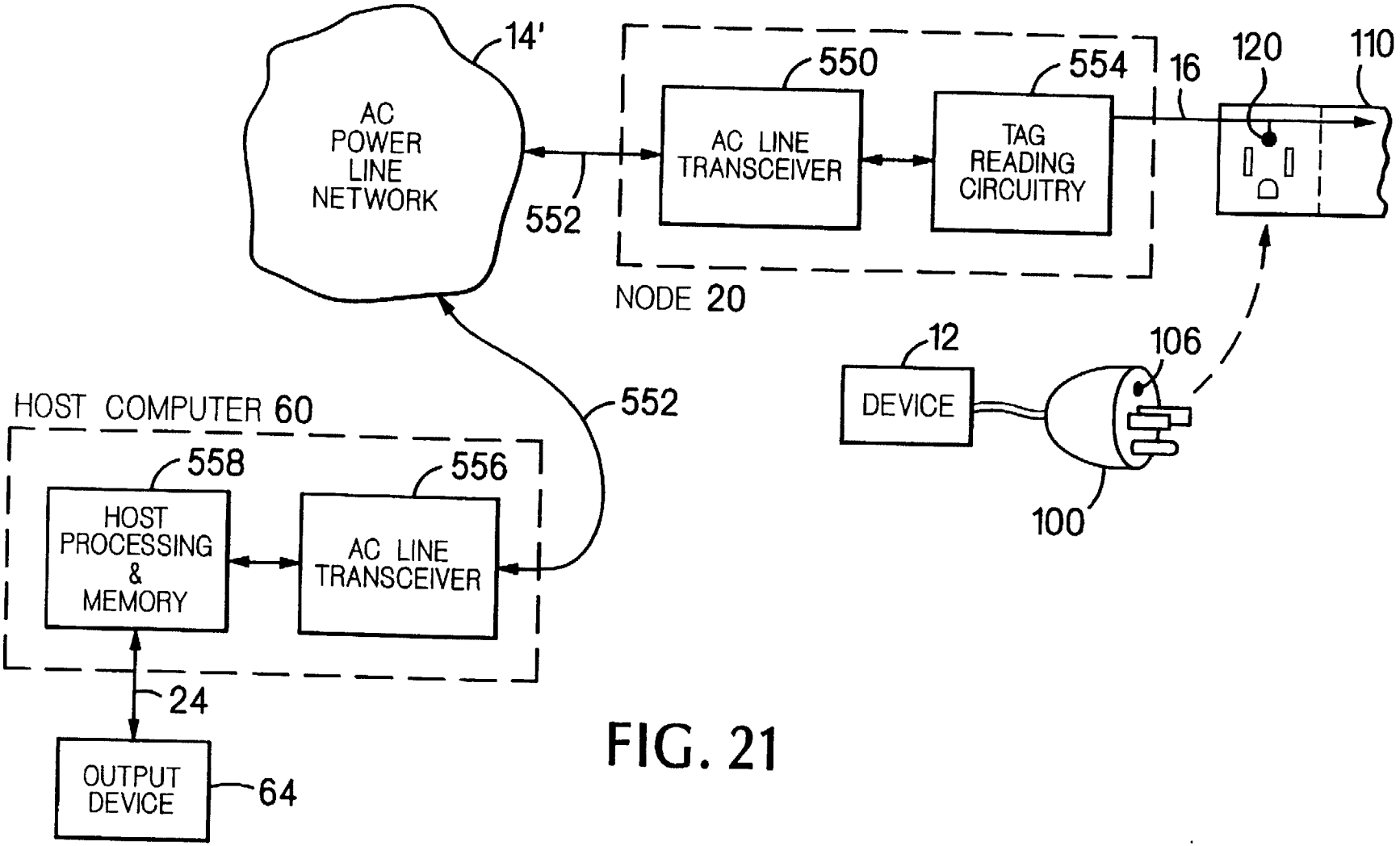
FIG. 21 illustrates the use of the AC power lines of a facility to form all or part of the network.

Referring to FIG. 21, as discussed above, in any of the embodiments of the invention, all or part of network 14 may be implemented using the AC power lines 14' of the facility. In this case, each node 20 that communicates with power line network 14' includes an AC line transceiver 550 that serves as an interface between branches 552 of AC power lines 14' and tag reading circuitry 554. Tag reading circuitry 554 reads data structures 32 (FIG. 2) of all tags 30 connected to communication links 16 served by node 20 in the same manner as discussed above and in the '929 application. Transceiver 550 converts the data signals produced by tag reading circuitry 554 into suitable form (such as differential or common mode) for transmission over the AC line and AC neutral wires of power line network 14'. Transceiver 550 and tag reading circuitry 554 are available together as a PLC-10 power line control module, model 56010, available from Echelon Corporation in Palo Alto, Calif.

Host computer 60 is also equipped with an AC line transceiver 556 that receives the data signals from a branch 552 of AC power line network 14' and converts them to a form suitable for use by host processing and memory 558. Transceiver 558 is available from Echelon Corporation. Host processing and memory 556 is identical to that discussed above and in the '929 application, and communicates with output device 64 (or other computers or workstations of system 10) over, e.g., network branch 24.

Network 14' is easily and inexpensively implemented in a building with power line network (which has been optimized for such powerline communication), without installing any new wiring in the building. This is done by distributing any of the AC outlets described in this application in key inventory locations in the building (e.g. in storerooms 18), installing AC line transceivers 550, 556 in nodes 20 and host computer 60, and providing each device 12 in the inventory with any one of the tag-equipped AC plugs described herein.

Figure 22:
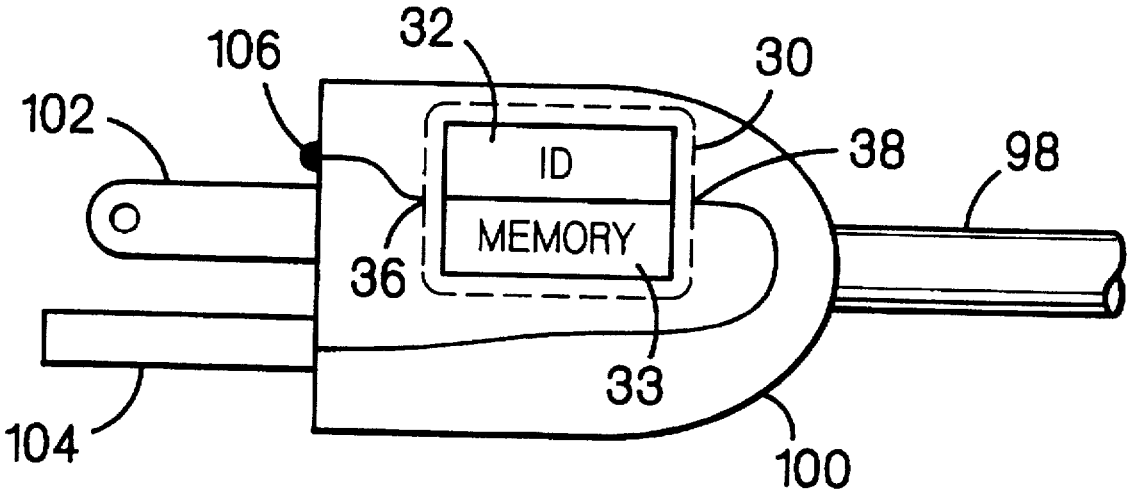
FIG. 22 shows an electronic tag with internal memory mounted to an AC plug.

Referring to FIG. 22, in any of the embodiments described herein, tag 30 may include a memory 33 (and battery 35, not shown) in addition to data structure 32 (FIG. 2). Examples of such a tag include the aforementioned Dallas Semiconductor DS1991–DS1994 touch memories. Data ports 36, 38 also serve to connect memory 33 between data contact 106 and ground pin 104 of plug 100. Host computer 60 (FIG. 1) writes data to memory 33 via communication link 16 and the connection between data contact 106 and data contact 120 when plug 100 is inserted in a receptacle 112 of outlet 110 (FIG. 4). The writing procedure is described in detail in *Book of DS 199x Touch Memory Standards* by Dallas Semiconductor (1992), (see, in particular, Chapters 1, 4, and 5), in product specification sheets for parts 1991–1994, 2405, and in "1991 Automatic Identification Data Book" (particularly Application Note: Using the 1-wire Protocol). All of this literature is incorporated herein by reference, and thus the writing procedure will not be described further here. Examples of data written to memory 33 include maintenance information, and device ownership information.

Figure 23:
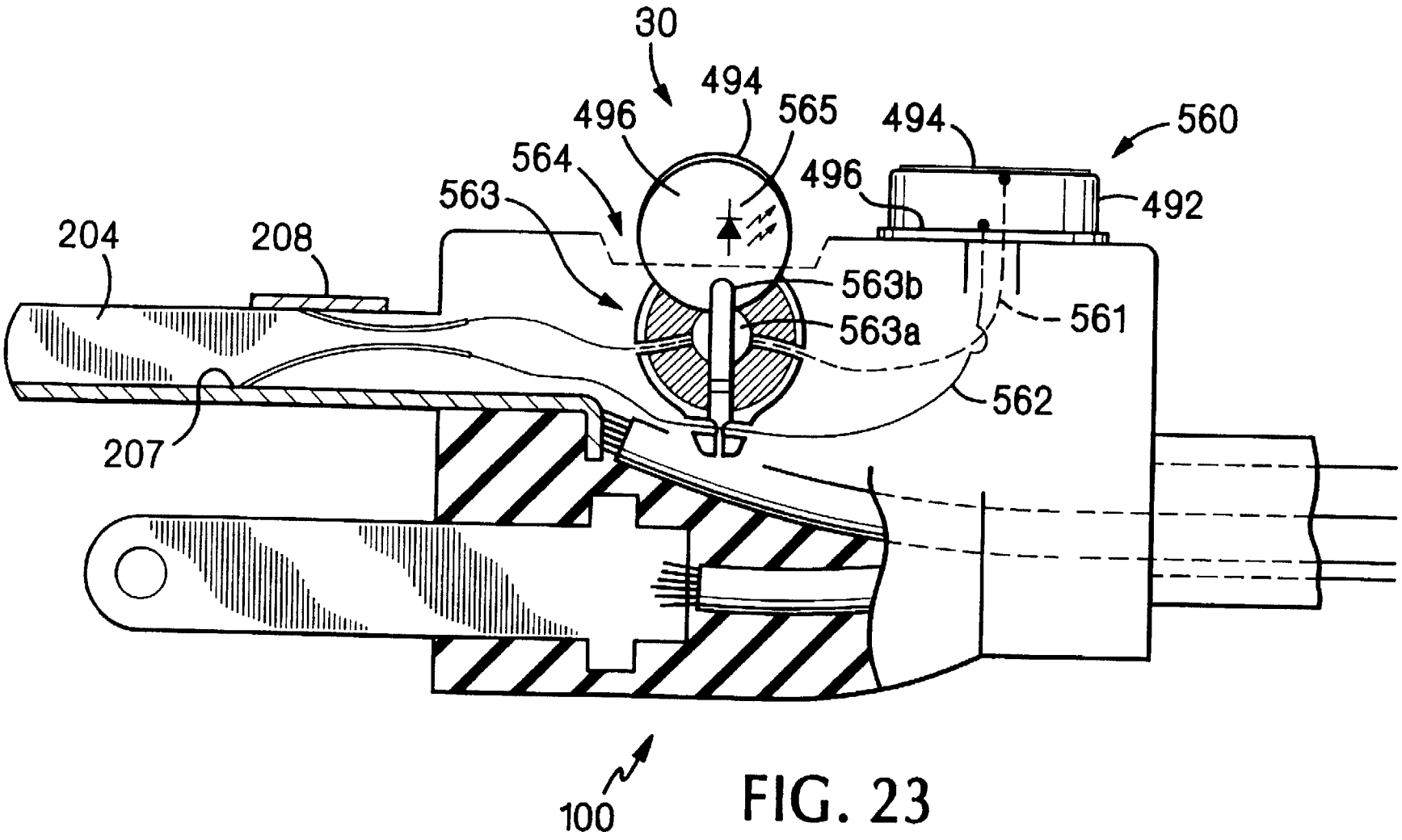
FIG. 23 illustrates a second connector mounted to the plug for accessing the electronic tag.

Referring to FIG. 23, tag 30 can optionally be accessed by a secondary connector 560 connected to tag 30 in parallel with data contact 106. Secondary connector 560 includes housing 492 (FIG. 18) that does not contain a tag, but includes data and ground wires 561, 562 connected to surfaces 494, 496. This "empty" housing 492 is available from Dallas Semiconductor as part no. DS9092R. Tag 30 (also disposed in a housing 492) is mounted in a conventional coin cell battery holder 563 embedded within the housing of plug 100. Terminals **563*a*, 563*b* of holder 563 engage data ports 38, 38 via surfaces 494, 496, and also receive wires 561, 562. In addition, terminal 563*a* is wired to data contact 208 (FIGS. 6–8) on ground pin 204; terminal 563*b* is grounded at ground contact 207**.

As a result, tag 30 is accessible from both communication link 16 (as described above) and secondary connector 560. This allows a user to exchange information with tag 30 using a touch and hold probe 534 (FIG. 20) or other suitable reader.

Tag 30 may be removable from the housing of plug 100 by providing an access port 564, which may be equipped with a lid or the like for covering tag 30 and assisting retaining tag 30 within the housing. Alternatively, access port 564 can be open, and the friction provided by terminals **563*a*, 563*b* relied upon to retain tag 30**.

In addition, tag 30 may be equipped with an LED 565 or other suitable illumination device that can be energized by circuitry in tag 30 in response to a command received from host computer 60 over communication link 16. This is particularly useful if the plug housing is translucent. Among other advantages, illuminating LED 565 "flags" device 12 associated with tag 30 to aid a user in selecting device 12 from among numerous other devices 12 in the same location.

Figure 24:
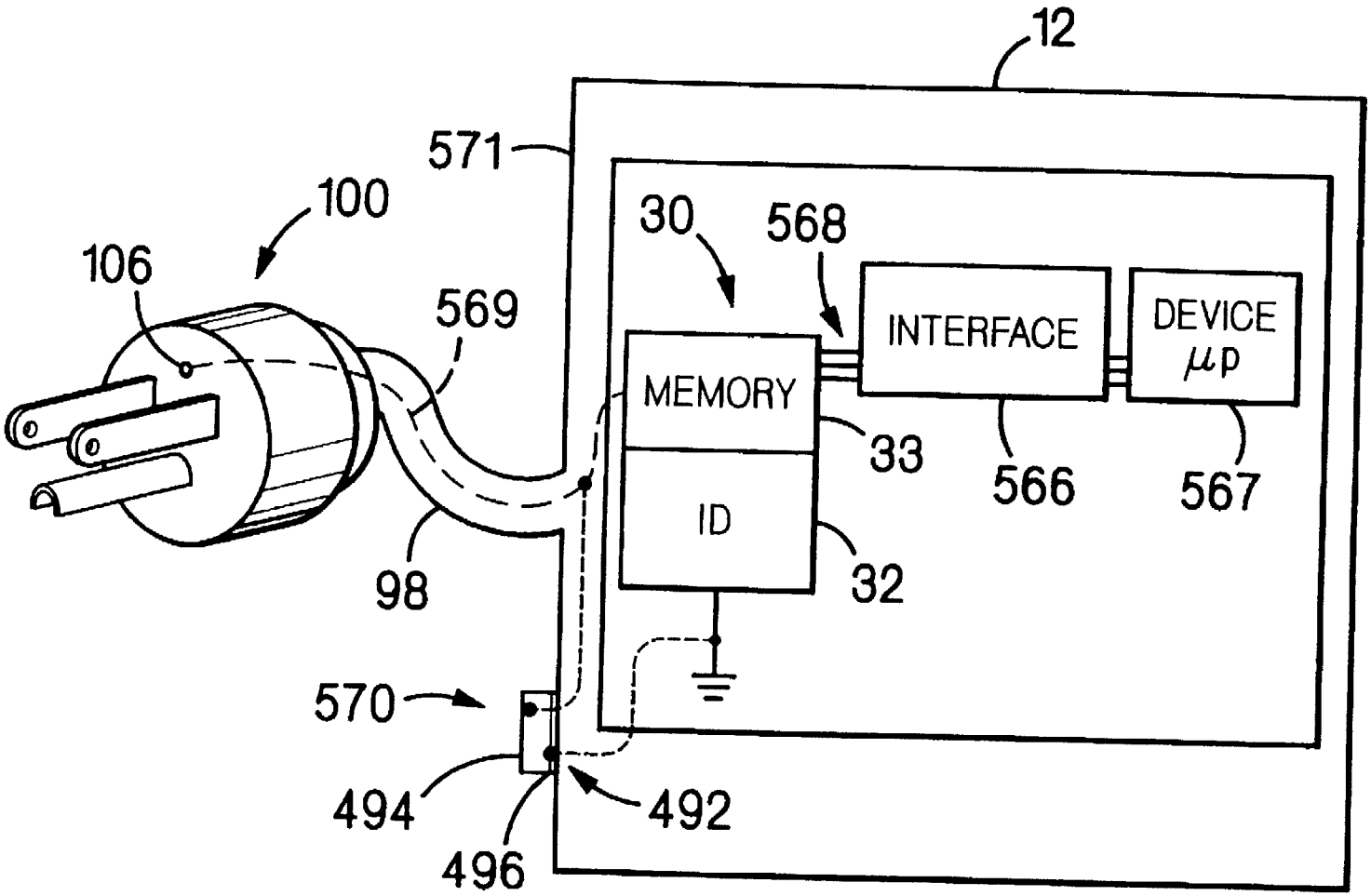
FIGS. 24 and 25 show further uses of the electronic tag.

Referring to FIG. 24, in another embodiment, tag memory 33 is additionally connected to a microprocessor 567 in a device 12 through an interface 566 connected to memory 33 through leads 568. Tag 30, interface 566, and leads 568 are available together as a Dallas Dual Ported Touch Memory DS2404-001 (reference: "50 Ways to Touch Memory, Second Edition", October, 1992, Dallas Semiconductor, incorporated herein by reference). In this case, tag 30 is located within device 12 (rather than in AC plug 100) to minimize the length of leads 568. Data contact 106 is connected to tag 30 by a wire 569 that extends through cord 98, which is either permanently fixed to device 12 (as shown) or connected thereto with a modular plug. Of course, tag 30 can alternatively be placed in any of the positions described above.

In the embodiment shown in FIG. 24, with AC plug 100 inserted in a receptacle 112 of outlet 110 and data contact 106 in engagement with data contact 120, tag 30—and thus memory 33—is connected to network 14 via communication link 16 in the manner described above. Using the data link provided by communication link 16, host computer 60 (FIG. 1) can capture data about the operation of device 12 stored by microprocessor 567 in memory 33 (e.g., run-time information). In addition, host computer 60 may control device 12 over network 14 by communicating with microprocessor 567 through tag 30. For example, host computer 60 may load operating parameters for device 12 in memory 33, which are used by microprocessor 567 to adjust the operation of device 12 accordingly.

A secondary connector 570 can be mounted to an exterior surface 571 of device 12 to provide the parallel access discussed above. Housing surface 494 is linked to wire 569, while housing surface 496 is grounded. As a result, secondary connector 570 is connected to tag 30 in parallel with data contact 106 and the ground pin of plug 100.

Figure 25:
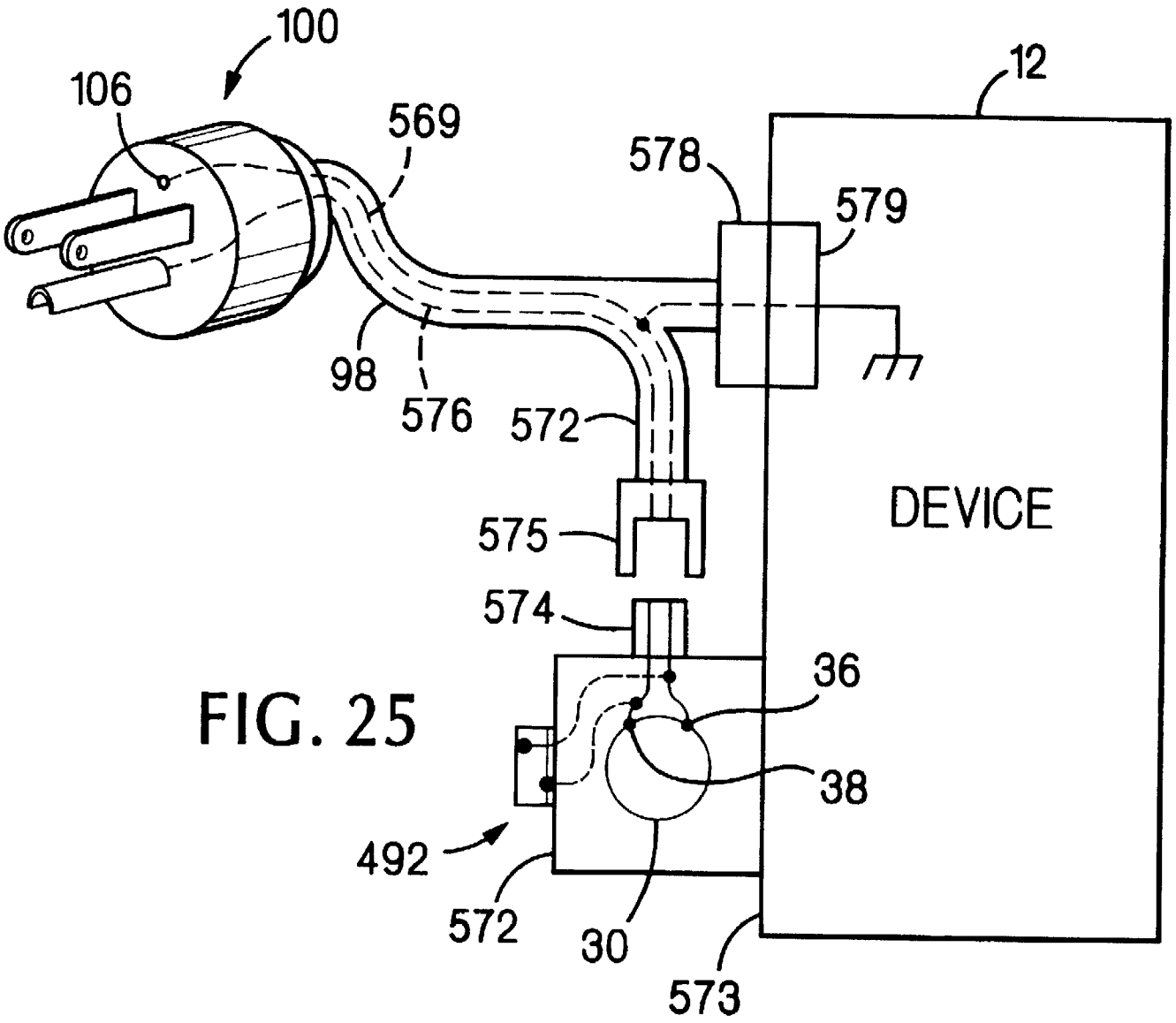

Referring to FIG. 25, tag 30 is mounted externally to device 12 in a block 572 that is secured (permanently or otherwise) to an exterior surface 573 of device 12. Data ports 36, 38 of tag 30 are wired to a modular connector 574 on block 572. A mating connector 575 receives data wire 569 and ground wire 576 from cord 98 via sheath 577. A modular power connector 578 on cord 98 engages a like power connector 579 on device 12 to supply AC power thereto, and provides the device-ground connection for wire 576.

When connectors 574, 575 (which are, e.g., RJ-11 type connectors) are engaged, they complete the electrical connection from data contact 106 and the ground pin of plug 100 to tag 30. In addition, tag 30 is accessible via a parallel, secondary connector (such as empty housing 492), which is wired as discussed above to the electrical connections of tag 30.

The modular tag and power connections provided by connectors 575, 578 (FIG. 25) can also be used with, e.g., the arrangement shown in FIG. 23. For example, secondary connector 570 may be mounted on a block that includes a modular connector 574 for receiving connector 575. In addition, connectors 578, 579 would also provide the electrical connections to tag 30.

Figure 26:
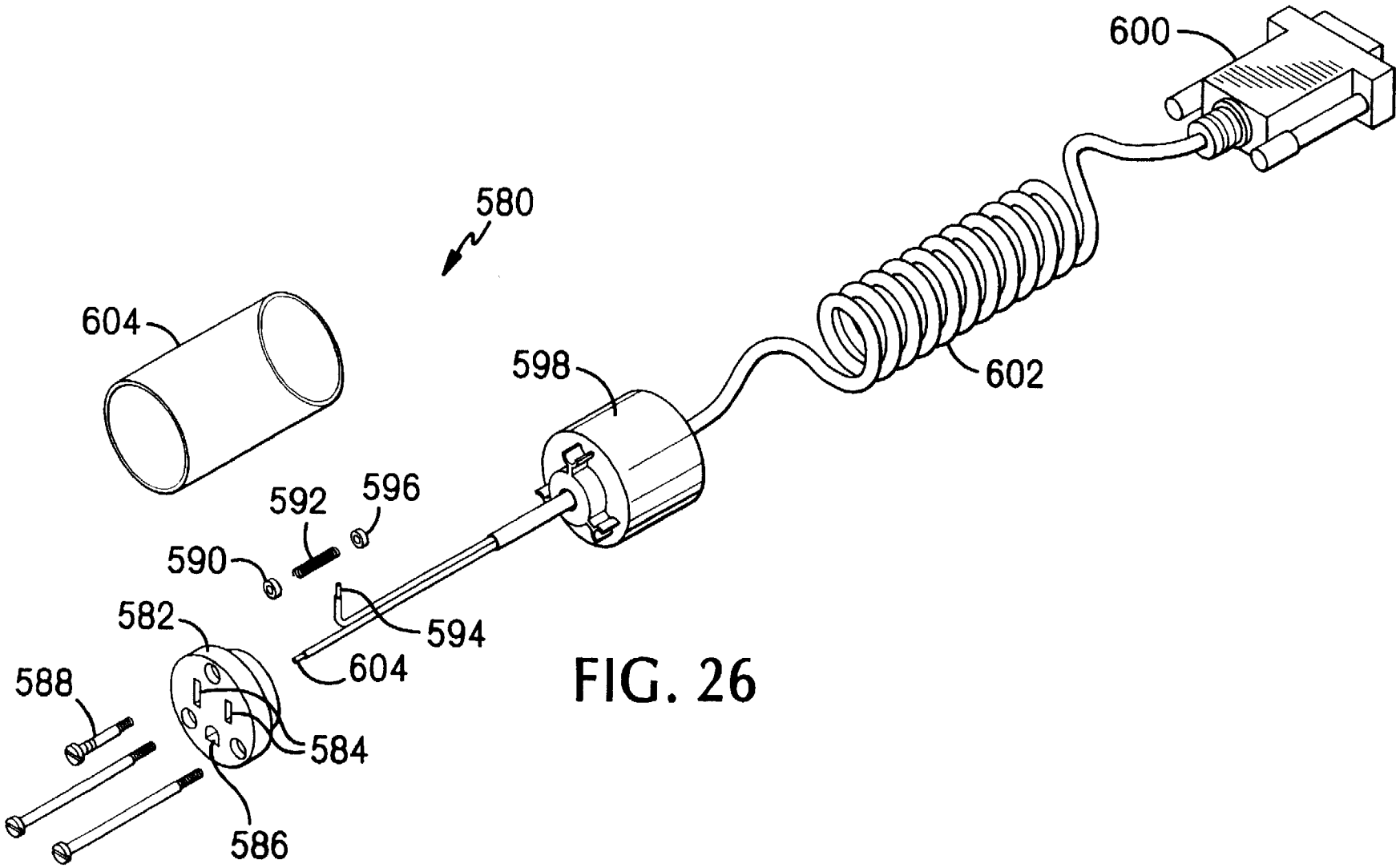
FIG. 26 is an exploded view of an accessory for reading the electronic tag via an input port of a computer.

Referring to FIG. 26, tag 30 mounted to any of the AC plugs described herein (e.g., AC plug 100 of FIG. 4) can be read directly by a personal computer with accessory 580. Accessory 580 includes a female AC receptacle 582 that receives AC plug 100 but lacks wiring for applying AC power to plug 100—in other words, receptacle 582 is a "dummy" AC outlet. The AC line and neutral terminals 584 and ground terminal 586 receive blades 102 and ground pin 104 (FIG. 4) of plug 100 so that data contact 106 of plug 100 is in alignment with a data contact 588 mounted in receptacle 582.

Data contact 588 is in the form of screw positioned above and centered between the AC terminals 584. The head of data contact screw 588 protrudes slightly from the face of receptacle 582. The opposite end of data contact screw 588 is threaded into a nut 590 permanently fixed to a spring 592 that is soldered to data wire 594. The opposite end of spring 592 is rigidly secured to a nut 596 mounted on receptacle body 598. Thus, screw 588 (which serves as data contact 106) is spring mounted within receptacle 582.

Data wire 594 provides an electrical connection between data contact screw 588 and a computer serial port connector 600 through a cable 602. Ground terminal 586 is electrically connected to ground wire 604, which also runs through cable 602 to serial port connector 600. Serial port connector 600 is configured to engage, for example, the serial RS 232 port of a computer, but any suitable computer connector may be used instead. Receptacle 582, body 598, and the associated wiring are mounted within a plastic housing 604. A pair of screws 606 advanced through receptacle 582 and threaded into body 598 secure accessory 580 together.

In use, when plug 100 is inserted into receptacle 582, data contact screw 588 engages and is depressed by data contact 106 of plug 100. Spring 592 compresses and resists the depression of screw 588 to provide a firm connection with data contact 106 and place data port 36 of tag 30 in electrical contact with data wire 594. The engagement of plug ground pin 104 with ground terminal 586 electrically connects tag data port 38 to data wire 604. A user of the computer that receives connector 600 can, e.g., read tag data structure 32 or write information (such as maintenance data) into tag memory 560 (FIG. 22), if tag 30 is so equipped. Other uses for accessory 580 include reading data structures 32 of tags 30 in the embodiments of, e.g., FIGS. 9 and 10.

As mentioned above, receptacle 582 is a "dummy" AC outlet in that it does not include AC wiring for applying operating power to a plug 100. Using the same principle, any of the tag-equipped plugs described herein may be used to connect non-AC powered devices 12 to a communication link 16 via any of the described AC outlets without providing AC power connections. Such a "dummy" plug is identical to any of the tag-equipped plugs discussed above, but is simply tethered to a device 12 through a cord that does not include AC power connections.

Figure 27:
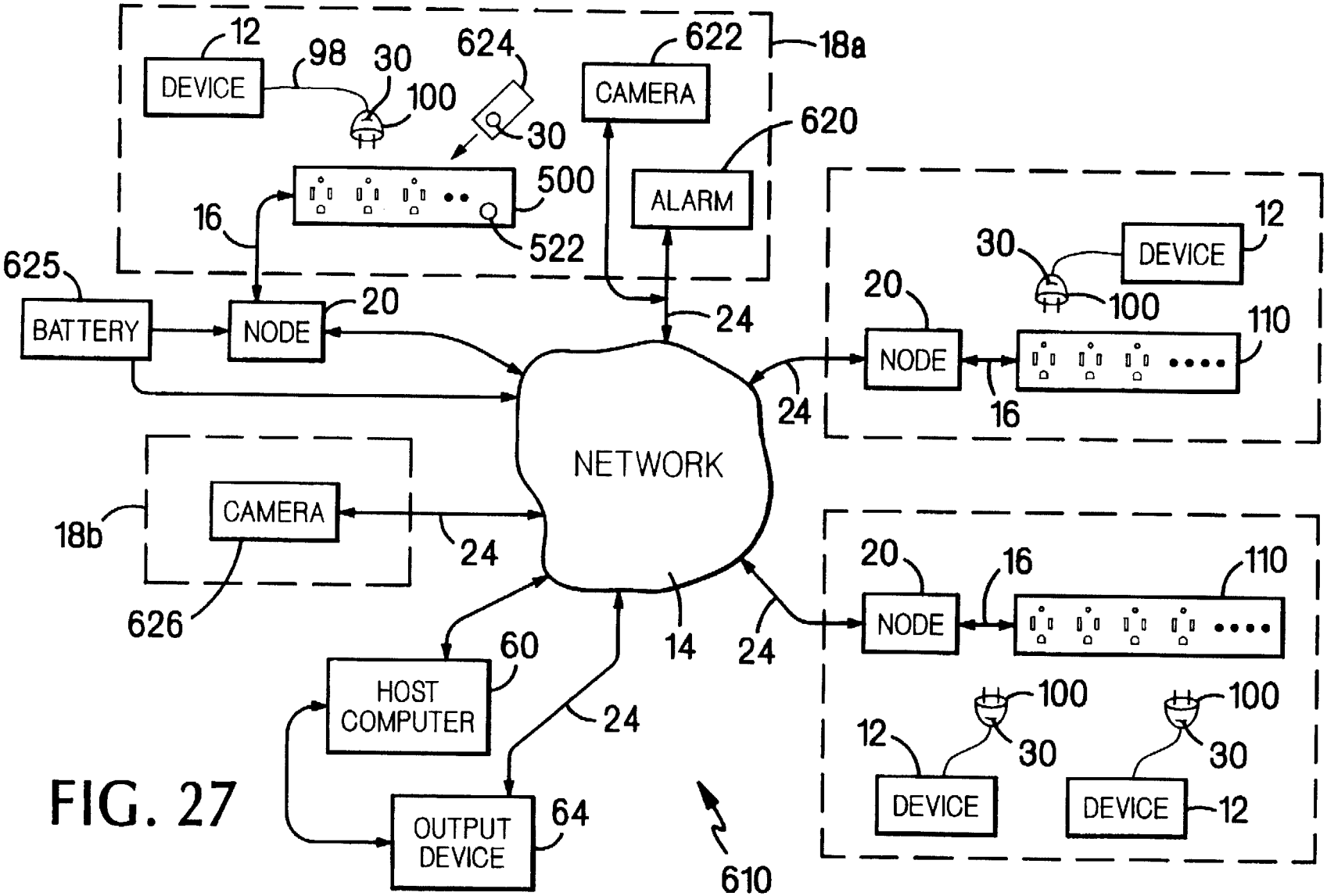
FIG. 27 illustrates another embodiment of a system for monitoring an inventory of devices through the use of a network.

Referring to FIG. 27, various embodiments of the tag-equipped AC plugs and corresponding AC outlets (individual outlets or multi-outlet power strips) configured to connect tags 30 onto communication links 16 can be used in any combination and with accessory devices (such as alarms and cameras) to provide a fully integrated system 610 for managing the inventory of devices For example, power strip 500 with a badge reader 522 (FIG. 20) is integrated with an alarm system 620 and digital camera 622 to provide a security subsystem in location (e.g., a storeroom or patient room). The security subsystem allows only those users with an authorized identifications (e.g., user IDs as indicated by tags 30 affixed to badges 624) can remove devices 12 (such as device **12*e*) plugged into power strip 500. Host computer 60 tracks whether device has been disconnected before a user ID has been read by badge reader 522, or whether the user ID is not in a list of authorized users stored in the database 64*a* of host computer 60. If either condition is met, host computer 60 notifies alarm system 620 over network 14 to sound an alarm, and directs digital camera 622 over network 14 to take a picture of the user. Digital camera 622 transmits the photograph of the unauthorized user of device 12*e* as a digital file to host computer 60 over network 14**.

Alarm system 620 functions best when host computer 60 continuously monitors devices 12—i.e., there are no gaps in surveillance during which the removal of devices 12 can go undetected by host computer 60. System 610 therefore includes a battery backup 625 that allows host computer 60 to continue monitoring device locations 18 during a power failure. In the above-discussed embodiment using AC power lines to define all or part of network 14', battery backup 625 is provided for each node 20. In other embodiments of network 14 (e.g., in which the network branches employ phone links), battery backup 625 is directly connected to a branch of network 14.

Another digital camera 626 monitors a location **18*b* in which, although not connected to network 14 via communication links 16, devices 12 are likely to accumulate —for example, a hallway. Digital camera 626 thus provides additional information concerning the locations of devices 12 to host computer 60**.

Still other embodiments are within the following claims.

What is claimed is:

1. A connector for use with a tag that is associated with a device and that identifies the device with respect to other devices, said connector comprising an element for engaging a corresponding element of an electrical power connector to establish an electrical power path between said connector and said electrical power connector, and another element electrically insulated from said element for establishing a data path between said tag and said electrical power connector that is separate from said electrical power path when said element is engaged with said corresponding element.

2. The connector of claim 1 wherein said another element includes a data contact connected to said tag and positioned on said connector to engage a corresponding data contact of said electrical power connector when said element is engaged with said corresponding element, thereby to establish said data path.

3. The connector of claim 1 further comprising a housing within which said tag is mounted.

4. The connector of claim 3 further comprising a cord for coupling said connector to said device.

5. The connector of claim 4 wherein said cord includes wiring for applying electrical power to said device when said connector is engaged with said electrical power connector.

6. The connector of claim 1 further comprising a second connector associated with said connector and electrically connected to said tag.

7. The connector of claim 6 further comprising a housing, said second connector being mounted to said housing.

8. The connector of claim 7 wherein said tag is mounted within said housing.

9. The connector of claim 8 wherein said tag includes an illumination device and circuitry for energizing said illumination device in response to a command received via said data path.

10. The connector of claim 1 wherein said tag is disposed externally to said connector.

11. The connector of claim 10 wherein said tag is mounted at said device, and further comprising a second connector mounted at said device and electrically connected to said tag.

12. The connector of claim 1 wherein said tag comprises an electronic memory including information identifying said device with respect to said other devices, said information being accessible for reading from said power source connector via said data path when said element is engaged with said corresponding element.

13. The connector of claim 12 wherein said information is unique with respect to all other tags.

14. The connector of claim 12 wherein said electronic memory includes storage for other information about said device, said storage being accessible from said electrical power connector via said data path when said element is engaged with said corresponding element.

15. The connector of claim 14 wherein said storage is electrically interfaced with a processor of said device.

16. A connector for use with a tag that is associated with a device and that identifies the device with respect to other devices, said connector comprising an element for engaging a corresponding element of an electrical power connector;

another element for establishing a data path between slid tag and said electrical power connector when said element is engaged with said corresponding element, said another element including a data contact connected to said tag and positioned on slid connector to engage a corresponding data contact of said electrical power connector when said element is engaged with said corresponding element, thereby to establish said data path, said data contact being mounted to said connector through a spring that resiliently urges said data contact against said corresponding data contact of said electrical power connector when said element is engaged with said corresponding element.

17. A connector for use with a tag that is associated with a device and that identifies the device with respect to other devices, said connector comprising an element for engaging a corresponding element of an electrical power connector;

another element for establishing a data path between said tag and said electrical power connector when said element is engaged with said corresponding element, said another element including a data contact connected to said tag and positioned on said connector to engage a corresponding data contact of said electrical power connector when said element is engaged with said corresponding element, thereby to establish said data path, said data contact and said element of said connector being spaced from each other on a surface of said connector that abuts said electrical power connector when said connector is engaged therewith.

18. The connector of claim 17 wherein said connector is a plug, and said element includes a pair of AC power contacts and a ground pin spaced from each other on said surface, said data contact being disposed in a selected orientation with respect to said ground pin.

19. The connector of claim 18 further comprising a ground contact electrically connected to said tag and to said ground pin.

20. A connector for use with a tag that is associated with a device and that identifies the device with respect to other devices, said connector comprising an element for engaging a corresponding element of an electrical power connector, said element including a ground pin;

another element for establishing a data path between said tag and said electrical power connector when said element is engaged with said corresponding element, said another element including a data contact connected to said tag, said data contact being supported by and electrically insulated from said ground pin and being positioned on said connector to engage a corresponding data contact of said electrical power connector when said ground pin is engaged with said corresponding element, thereby to establish said data path.

21. The connector of claim 20 wherein said data contact includes an electrically conductive member mounted by an insulator to said ground pin.

22. The connector of claim 20 further comprising a ground contact electrically connected to said tag and to said ground pin.

23. The connector of claim 22 wherein said ground pin includes an opening therein, said data contact being disposed in said opening and said ground contact being electrically connected to said ground pin.

24. The connector of claim 23 wherein electrical connections between said tag and said data contact and said ground contact are disposed in an insulating sheath disposed in said opening.

25. The connector of claim 23 wherein said tag is mounted within said opening.

26. A connector for use with a tag that is associated with a device and that identifies the device with respect to other devices, said connector comprising an element for engaging a corresponding element of an electrical power connector;

another element for establishing a data path between said tag and said electrical power connector when said element is engaged with said corresponding element; and a housing within which said tag is mounted, a portion said housing providing access to said tag so that said tag can be removed from said housing for replacement.

27. The connector of claim 26 wherein said connector comprises an adapter for receiving a plug electrically connected to said device by a cord, and electrically connecting said plug to said electrical power connector to apply electrical power to said device.

28. A connector for use with a tag that is associated with a device and that identifies the device with respect to other devices, said connector comprising an element for engaging a corresponding element of an electrical power connector;

another element for establishing a data path between said tag and said electrical power connector when said element is engaged with said corresponding element;

a second connector associated with said connector and electrically connected to said tag, said second connector being mounted to a housing within which said tag is mounted, said housing being constructed to allow said tag to be removed therefrom for replacement or repair.

29. A connector for use with a tag that is associated with a device and that identifies the device with respect to other devices, said connector comprising an element for engaging a corresponding element of an electrical power connector;

another element for establishing a data path between said tag and said electrical power connector when said element is engaged with said corresponding element;

said tag being disposed externally to said connector and being mounted at said device; and a cord connected between said connector and said device, said cord including at least one electrical connection between said tag and said another element.

30. A connector for use with a tag that is associated with a device and that identifies the device with respect to other devices, said connector comprising an element for engaging a corresponding element of an electrical power connector;

another element for establishing a data path between said tag and said electrical power connector when said element is engaged with said corresponding element;

said tag being disposed externally to said connector and being mounted to an exterior surface of said device, and further comprising a cord connected between said connector and said device, said cord including at least one electrical connection between said tag and said another element.

31. The connector of claim 30 further comprising a second connector mounted at said device and connected to said tag.

32. The connector of claim 30 wherein said at least one electrical connection includes a third connector for providing a releasable electrical connection to said tag.

33. An electrical power connector for use with a tag associated with a device and that identifies the device with respect to other devices, said connector comprising an element for engaging a corresponding element of a device connector of said device to establish an electrical power path between said device connector and said electrical power connector, said device connector including an electrical connection to said tag, and another element electrically insulated from said element for establishing a data path between a communication link associated with said electrical power connector and said device connector that is separate from said electrical power path when said element is engaged with said corresponding element, thereby provide access to said tag from said communication link.

34. The electrical power connector of claim 33 wherein said another element includes a data contact connected to said communication link and positioned on said electrical power connector to engage a corresponding data contact of said device connector when said element is engaged with said corresponding element, thereby to establish said data path.

35. The electrical power connector of claim 34 wherein said data contact of said connector is disposed on a substrate mounted to an exterior surface of said electrical power connector.

36. The electrical power connector of claim 34 wherein said data contact is disposed on said connector adjacent to said element of said electrical power connector.

37. The electrical power connector of claim 34 further comprising a second connector electrically connected to said data contact of said electrical power connector and configured to engage an input port of a computer.

38. The electrical power connector of claim 33 further comprising a terminal connected to said communication link to provide an external electrical connection to said communication link.

39. An electrical power connector for use with a tag associated with a device and that identifies the device with respect to other devices, said connector comprising an element for engaging a corresponding element of a device connector of said device and applying electrical power to said corresponding element, said device connector including an electrical connection to said tag;

another element for establishing a data path between a communication link associated with said electrical power connector and said device connector when said element is engaged with said corresponding element, thereby to provide access to slid tag from said communication link, said another element including a data contact connected to said communication link and positioned on said electrical power connector to engage a corresponding data contact of said device connector when said element is engaged with said corresponding element, thereby to establish said data path;

wherein said device connector is a plug and said element of said connector includes a ground terminal for receiving a ground pin of said plug, said data contact of said electrical power connector being mounted to said ground terminal and electrically insulated therefrom.

40. The electrical power connector of claim 39 wherein said data contact of said connector is disposed in said ground terminal to slidingly contact said data contact of said plug when said ground pin is inserted in said ground terminal.

41. An electrical power connector for use with a tag associated with a device and that identifies the device with respect to other devices, said connector comprising an element for engaging a corresponding element of a device connector of said device and applying electrical power to said corresponding element, said device connector including an electrical connection to said tag;

another element for establishing a data path between a communication link associated with said electrical power connector and said device connector when said element is engaged with said corresponding element, thereby to provide access to said tag from said communication link;

wherein said device connector is a plug and said element includes a receptacle for receiving said plug, and further comprising a plurality of said receptacles, each of said receptacles having a said another element associated therewith.

42. The electrical power connector of claim 41 wherein each said another element is connected to said communication link.

43. The electrical power connector of claim 41 wherein at least one of said another elements is connected to a second communication link associated with said electrical power connector.

44. An electrical power connector for use with a tag associated with a device and that identifies the device with respect to other devices, said connector comprising an element for engaging a corresponding element of a device connector of said device and applying electrical power to said corresponding element, said device connector including an electrical connection to said tag;

another element for establishing a data path between a communication link associated with said electrical power connector and said device connector when said element is engaged with said corresponding element, thereby to provide access to said tag from said communication link;

a terminal connected to said communication link to provide an external electrical connection to said communication link; and a second said electrical power connector having a communication link electrically connected to said terminal of the first mentioned electrical power connector.

45. An electrical power connector for use with tag associated with a device and that identifies the device with respect to other devices, said connector comprising an element for engaging a corresponding element of a device connector of said device and applying electrical power to said corresponding element, said device connector including an electrical connection to said tag;

another element for establishing a data path between a communication link associated with said electrical power connector and said device connector when said element is engaged with said corresponding element, thereby to provide access to said tag from said communication link; and an auxiliary connector associated with said electrical power connector for receiving at least one other tag associated with another one of said devices and connecting said at least one other tag to a second communication link.

46. The electrical power connector of claim 45 wherein said second communication link is connected to the first mentioned communication link of said electrical power connector.

47. The electrical power connector of claim 45 wherein said auxiliary connector is configured to connect multiple said tags simultaneously to said second communication link.

48. The electrical power connector of claim 45 wherein said auxiliary connector is configured to connect said tags to said second communication link one at a time.

49. Apparatus for connecting a tag associated with a device and that identifies the device with respect to other devices to a communication link to allow information to be exchanged between said communication link and said tag, comprising a device connector attached by a cord to said device and including an element for receiving electrical power and a first data contact connected to said tag and electrically insulated from said element of said device connector, and an electrical power connector having an element, for engaging said element of said device connector to establish an electrical power path between said device connector and said electrical power connector, and a second data contact connected to said communication link and electrically insulated from said element of said electrical power connector, said first data contact and said second data contact being positioned to engage one another and establish a data path between said communication link and said tag that is separate from said electrical power path when said element of said device connector is engaged with said element of said electrical power connector.

50. The apparatus of claim 49 wherein said tag comprises an electronic memory including information identifying said device with respect to said other devices, said information being accessible for reading from said communication link via said data path when said element of said device connector is engaged with said element of said electrical power connector.

51. The apparatus of claim 50 wherein said electronic memory includes storage for other information said device, said storage being accessible from said communication link via said data path when said element is engaged with said element of said electrical power connector.

52. The apparatus of claim 49 wherein said communication link is part of a network, a branch of which includes an AC power line that carries electrical power, and further comprising a transceiver for exchanging said information between said communication link and said AC power line.

53. Apparatus for connecting a tag associated with a device and that identifies the device with respect to other devices to a communication link to allow information to be exchanged between said communication link and said tag, comprising a device connector attached by a cord to said device and including an element for receiving electrical power and a first data contact connected to said tag;

an electrical power connector having an element for engaging said element of said device connector and applying electrical power thereto, and a second data contact connected to said communication link;

said first data contact and said second data contact being positioned to engage one another and establish a data path between said communication link and said tag when said element of said device connector is engaged with said element of said electrical power connector;

wherein at least one of said first data contact and said second data contact is mounted to its respective connector through a spring that resiliently urges said at least one data contact against the other said data contact when said element of said device connector is engaged with said element of said electrical power connector.

54. Apparatus for connecting a tag associated with a device and that identifies the device with respect to other devices to a communication link to allow information to be exchanged between said communication link and said tag, comprising a device connector attached by a cord to said device and including an element for receiving electrical power and a first data contact connected to said tag, said device connector being an AC power plug, said element of said device connector including a pair of AC power contacts and a ground pin spaced from each other on a surface of said plug, and an electrical power connector having an element for engaging said element of said device connector and applying electrical power thereto, and a second data contact connected to said communication link, said electrical power connector being an AC power outlet, said element of said electrical power connector including a pair of AC power terminals and a ground terminal spaced from each other on a surface of said outlet, and said first data contact and said second data contact being positioned to engage one another and establish a data path between said communication link and said tag when said pair of AC contacts and said ground pin of said device connector are engaged with said pair of AC power terminals and said ground terminal of said electrical power connector.

55. The apparatus of claim 54 wherein said first data contact is spaced and said second data contact is spaced from said AC power terminals and said ground terminal on said surface of said outlet.

56. The apparatus of claim 54 wherein said first data contact is mounted to said ground pin and said second data contact is mounted to said ground terminal.

57. The apparatus of claim 56 wherein said first data contact and said second data contact are arranged to avoid short circuiting of said second data contact to said ground terminal.

58. The apparatus of claim 54 wherein said tag is mounted Within a housing of said device connector.

59. The apparatus of claim 54 wherein said tag is mounted to said ground pin.

60. Apparatus for connecting a tag associated with a device and that identifies the device with respect to other devices to a communication link that is part of a network to allow information to be exchanged between said communication link and said tag, comprising a device connector attached by a cord to said device an including an element for receiving electrical power and a first data contact connected to said tag;

an electrical power connector having an element for engaging said element of said device connector and applying electrical power thereto, and a second data contact connected to said communication link;

said first data contact and said second data contact being positioned to engage one another and establish a data path between said communication link and said tag when said element of said device connector is engaged with said element of said electrical power connector; and a camera for producing an image of a location in which said power source connector is disposed, said camera transmitting said image of said location over said network in response to a selected event.

61. The apparatus of claim 60 further comprising a monitor for identifying a user who disconnects said device connector from said electrical power connector and generating an alarm if the user is unauthorized to disconnect said device connector from said electrical power connector, said alarm serving as said selected event.

62. The apparatus of claim 61 wherein said monitor includes a reader for reading a tag that is associated with the user and that identifies the user with respect to other users.

63. Apparatus comprising a tag associated with a device and that stores information identifying the device with respect to other devices, a data contact and a ground contact connected to said tag, an insulator for insulating said data contact from said ground contact, at least said data contact, said ground contact, and said insulator being sized to fit within a cavity in a ground element of a connector, with said ground contact being in electrical contact with the ground element and said data contact being insulated from the ground element, said data contact being positioned to establish, when said connector is engaged with a mating connector, a data path over which said information is accessible from said connector.

64. The apparatus of claim 63 further comprising a pair of wires connected between said tag and said data contact and said ground contact, said insulator insulating said wires from said ground element.

65. The apparatus of claim 64 wherein said insulator comprises a sheath disposed within said cavity within which at least said wires are disposed.

66. The apparatus of claim 63 wherein said insulator comprises an adhesive for securing said data contact to said ground element.

67. The apparatus of claim 63 wherein said tag is disposed in said cavity of said ground element.

68. The apparatus of claim 63 wherein said connector is a plug and said ground element is a ground pin of said plug.

69. A method of connecting a tag associated with a device and that identifies the device with respect to other devices to a communication link to allow information to be exchanged between said communication link and said tag, comprising providing a device connector attached by a cord to said device and including an element for receiving electrical power and a first data contact connected to said tag and electrically insulated from said element of said device connector, providing an electrical power connector having an element for engaging said element of said device connector and applying electrical power thereto, and a second data contact connected to said communication link and electrically insulated from said element of said power connector, and connecting said device connector to said electrical power connector so that said element of said device connector engages said element of said electrical power connector to establish an electrical power path between said device connector and said electrical power connector, and said first data contact and said second data contact engage one another and establish a data path between said communication link and said tag that is separate from said electrical power path.

* * * * *